US011665495B2

(12) United States Patent
Gault

(10) Patent No.: US 11,665,495 B2
(45) Date of Patent: May 30, 2023

(54) METHODS, SYSTEMS, APPARATUSES, AND DEVICES FOR FACILITATING ENHANCED PERCEPTION OF AMBIANCE SOUNDSTAGE AND IMAGING IN HEADPHONES AND COMPREHENSIVE LINEARIZATION OF IN-EAR MONITORS

(71) Applicant: Nicolas John Gault, St Augustine, FL (US)

(72) Inventor: Nicolas John Gault, St Augustine, FL (US)

( * ) Notice: Subject to any disclaimer, the term of this patent is extended or adjusted under 35 U.S.C. 154(b) by 0 days.

(21) Appl. No.: 17/480,100

(22) Filed: Sep. 20, 2021

(65) Prior Publication Data

US 2022/0095065 A1 Mar. 24, 2022

Related U.S. Application Data

(60) Provisional application No. 63/080,593, filed on Sep. 18, 2020.

(51) Int. Cl.

| | |
|---|---|
| ***H04S 1/00*** | (2006.01) |
| ***H04R 3/04*** | (2006.01) |
| ***H04R 29/00*** | (2006.01) |

(52) U.S. Cl.

CPC ..... *H04S 1/005* (2013.01); *H04R 3/04* (2013.01); *H04R 29/002* (2013.01)

(58) Field of Classification Search

None

See application file for complete search history.

(56) References Cited

U.S. PATENT DOCUMENTS

| | | | | |
|---|---|---|---|---|
| 4,356,349 | A | 10/1982 | Robinson | |
| 5,420,929 | A | 5/1995 | Geddes | |
| 8,320,591 | B1 | 11/2012 | Wurtz | |
| 9,706,327 | B2 | 7/2017 | Brannmark | |
| 10,080,076 | B2 | 9/2018 | Karasawa | |
| 2006/0045294 | A1 | 3/2006 | Smyth | |
| 2008/0031462 | A1 | 2/2008 | Walsh | |
| 2008/0175396 | A1 | 7/2008 | Ko | |
| 2017/0195794 | A1 | 7/2017 | Vaynberg | |
| 2019/0215640 | A1 * | 7/2019 | Murata | H04R 3/005 |

FOREIGN PATENT DOCUMENTS

| | | | |
|---|---|---|---|
| IN | 2006CHO1549 | A | 6/2020 |
| WO | WO2017182715 | A1 | 10/2017 |

* cited by examiner

*Primary Examiner* — Kenny H Truong

(57) ABSTRACT

A method and system for facilitating enhanced perception of ambiance soundstage and imaging as well as frequency and phase response linearization in audio devices is provided. The method includes receiving measurement data from an omnidirectional microphone and linearizing the data, both in the amplitude and time domains, using digital signal processing. The method also includes a crossfeed algorithm designed to emulate sound propagation from speakers.

18 Claims, 13 Drawing Sheets

METHODS, SYSTEMS, APPARATUSES, AND DEVICES FOR FACILITATING ENHANCED PERCEPTION OF AMBIANCE SOUNDSTAGE AND IMAGING IN HEADPHONES AND COMPREHENSIVE LINEARIZATION OF IN-EAR MONITORS

The current application claims a priority to the U.S. provisional patent application Ser. No. 63/080,593 filed on Sep. 18, 2020. The current application is filed on Sep. 20, 2021 while Sep. 18, 2021 was on a weekend.

FIELD OF THE INVENTION

Generally, the present disclosure relates to the field of data processing. More specifically, the present disclosure relates to methods, systems, apparatuses, and devices for facilitating enhanced perception of ambiance, soundstage, and imaging in headphones as well as frequency and phase response linearization of in-ear monitors.

BACKGROUND OF THE INVENTION

The field of data processing is technologically important to several industries, business organizations, and/or individuals.

Existing techniques for facilitating enhanced perception of ambiance, soundstage, and imaging in headphones are deficient with regard to several aspects. For instance, current technologies do not provide crossfeed to opposite channels of a headphone with a 24-decibel (dB)/Octave low pass linear phase FIR filter, attenuating at 1600 hertz (Hz), with a time delay of 0.491 milliseconds (ms). Furthermore, current technologies do not linearize both headphone drivers so that they are synchronized in both amplitude and time domains. Furthermore, current technologies do not linearize in-ear monitors in both amplitude and time domains.

Therefore, there is a need for methods, systems, apparatuses, and devices for facilitating enhanced perception of ambiance soundstage and imaging in headphones as well as frequency and phase response linearization of in-ear monitors that may overcome one or more of the above-mentioned problems and/or limitations.

SUMMARY OF THE INVENTION

This summary is provided to introduce a selection of concepts in a simplified form, that are further described below in the Detailed Description. This summary is not intended to identify key features or essential features of the claimed subject matter. Nor is this summary intended to be used to limit the claimed subject matter's scope.

Disclosed herein is a method for facilitating enhanced perception of ambiance, soundstage, and imaging in audio devices, in accordance with some embodiments. The method may include a step of receiving, using a communication device, a right channel measurement data of a right audio device driver associated with a right channel of an audio device and a left channel measurement data of a left audio device driver associated with a left channel of the audio device from a microphone. Further, the method may include a step of duplicating, using a processing device, the right channel measurement data and the left channel measurement data. Further, the method may include a step of generating, using the processing device, a duplicate right channel measurement data for the right channel measurement data and a duplicate left channel measurement data for the left channel measurement data based on the duplicating. Further, the method may include a step of applying, using the processing device, an inversion function to the duplicate right channel measurement data and the duplicate left channel measurement data based on the generating of the duplicate right channel measurement data and the duplicate left channel measurement data. Further, the method may include a step of generating, using the processing device, a duplicate right inverted impulse data for the duplicate right channel measurement data and a duplicate left inverted impulse data for the duplicate left channel measurement data based on the applying. Further, the method may include a step of convolving, using the processing device, the right channel measurement data with the duplicate right inverted impulse data and the left channel measurement data with the duplicate left inverted impulse data based on the generating of the duplicate right inverted impulse data and the duplicate left inverted impulse data. Further, the method may include a step of generating, using the processing device, a right impulse data for the right audio device driver and a left impulse data for the left audio device driver based on the convolving. Further, the method may include a step of analyzing, using the processing device, the right impulse data and the left impulse data based on the generating of the right impulse data and the left impulse data. Further, the method may include a step of generating, using the processing device, a corrective signal data for one or more of the right audio device driver and the left audio device driver for linearizing the audio device in amplitude and time domains based on the analyzing. Further, one or more of the right audio device driver and the left audio device driver may be operated based on the corrective signal data. Further, the method may include a step of storing, using a storage device, the corrective signal data.

Further disclosed herein is a system for facilitating enhanced perception of ambiance soundstage and imaging in audio devices, in accordance with some embodiments. The system may include a communication device, a processing device, and a storage device. Further, the communication device may be configured for performing a step of receiving a right channel measurement data of a right audio device driver associated with a right channel of an audio device and a left channel measurement data of a left audio device driver associated with a left channel of the audio device from a microphone. The processing device may be communicatively coupled with the communication device. Further, the processing device may be configured for performing a step of duplicating the right channel measurement data and the left channel measurement data. Further, the processing device may be configured for performing a step of generating a duplicate right channel measurement data for the right channel measurement data and a duplicate left channel measurement data for the left channel measurement data based on the duplicating. Further, the processing device may be configured for performing a step of applying an inversion function to the duplicate right channel measurement data and the duplicate left channel measurement data based on the generating of the duplicate right channel measurement data and the duplicate left channel measurement data. Further, the processing device may be configured for performing a step of generating a duplicate right inverted impulse data for the duplicate right channel measurement data and a duplicate left inverted impulse data for the duplicate left channel measurement data based on the applying. Further, the processing device may be configured for performing a step of convolving the right channel measurement data with the duplicate right inverted impulse data and the left channel measurement data with the duplicate left inverted impulse data based on the generating of the duplicate right inverted impulse data and the duplicate left inverted impulse data. Further, the processing device may be configured for performing a step of generating a right impulse data for the right audio device driver and a left impulse data for the left audio device driver based on the convolving. Further, the processing device may be configured for performing a step of analyzing the right impulse data and the left impulse data based on the generating of the right impulse data and the left impulse data. Further, the processing device may be configured for performing a step of generating a corrective signal data for one or more of the right audio device driver and the left audio device driver for linearizing the audio device in amplitude and time domains based on the analyzing. Further, one or more of the right audio device driver and the left audio device driver is operated based on the corrective signal data. The storage device may be communicatively coupled with the processing device. Further, the storage device may be configured for performing a step of storing the corrective signal data.

Further disclosed herein is a method for facilitating linearizing of audio devices, in accordance with some embodiments. Accordingly, the method may include a step of receiving, using a communication device, a right channel measurement data of a right audio device driver associated with a right channel of an audio device and a left channel measurement data of a left audio device driver associated with a left channel of the audio device from a microphone. Further, the audio device may include an in-ear monitor. Further, the method may include a step of calculating, using a processing device, a vector average of the right channel measurement data and the left channel measurement data. Further, the method may include a step of generating, using the processing device, an impulse data of an impulse for the in-ear monitor based on the calculating. Further, the method may include a step of analyzing, using the processing device, the impulse data. Further, the method may include a step of generating, using the processing device, a correction impulse data of a correction impulse for the in-ear monitors based on the analyzing. Further, a convolution of the correction impulse and the impulse is a flat response. Further, the in-ear monitor may be operated based on the correction impulse data. Further, the method may include a step of storing, using a storage device, the correction impulse data.

Both the foregoing summary and the following detailed description provide examples and are explanatory only. Accordingly, the foregoing summary and the following detailed description should not be considered to be restrictive. Further, features or variations may be provided in addition to those set forth herein. For example, embodiments may be directed to various feature combinations and subcombinations described in the detailed description.

BRIEF DESCRIPTION OF DRAWINGS

The accompanying drawings, which are incorporated in and constitute a part of this disclosure, illustrate various embodiments of the present disclosure. The drawings contain representations of various trademarks and copyrights owned by the Applicants. In addition, the drawings may contain other marks owned by third parties and are being used for illustrative purposes only. All rights to various trademarks and copyrights represented herein, except those belonging to their respective owners, are vested in and the property of the applicants. The applicants retain and reserve all rights in their trademarks and copyrights included herein, and grant permission to reproduce the material only in connection with reproduction of the granted patent and for no other purpose.

Furthermore, the drawings may contain text or captions that may explain certain embodiments of the present disclosure. This text is included for illustrative, non-limiting, explanatory purposes of certain embodiments detailed in the present disclosure.

DETAILED DESCRIPTION OF THE INVENTION

Figure 1:
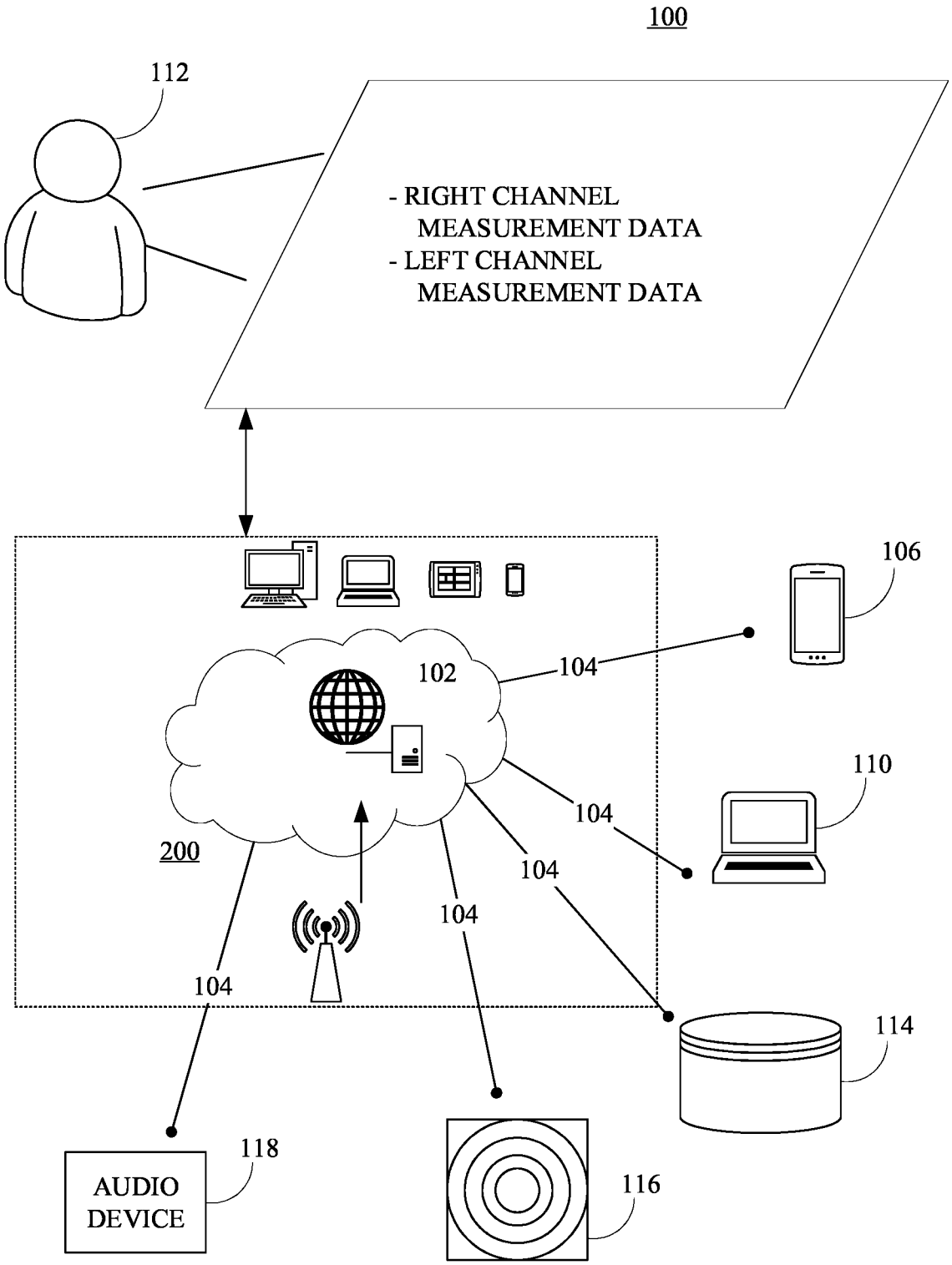
FIG. 1 is an illustration of an online platform consistent with various embodiments of the present disclosure.

As a preliminary matter, it will readily be understood by one having ordinary skill in the relevant art that the present disclosure has broad utility and application. As should be understood, any embodiment may incorporate only one or a plurality of the above-disclosed aspects of the disclosure and may further incorporate only one or a plurality of the above-disclosed features. Furthermore, any embodiment discussed and identified as being "preferred" is considered to be part of a best mode contemplated for carrying out the embodiments of the present disclosure. Other embodiments also may be discussed for additional illustrative purposes in providing a full and enabling disclosure. Moreover, many embodiments, such as adaptations, variations, modifications, and equivalent arrangements, will be implicitly disclosed by the embodiments described herein and fall within the scope of the present disclosure.

Accordingly, while embodiments are described herein in detail in relation to one or more embodiments, it is to be understood that this disclosure is illustrative and exemplary of the present disclosure, and are made merely for the purposes of providing a full and enabling disclosure. The detailed disclosure herein of one or more embodiments is not intended, nor is to be construed, to limit the scope of patent protection afforded in any claim of a patent issuing here from, which scope is to be defined by the claims and the equivalents thereof. It is not intended that the scope of patent protection be defined by reading into any claim limitation found herein and/or issuing here from that does not explicitly appear in the claim itself.

Thus, for example, any sequence(s) and/or temporal order of steps of various processes or methods that are described herein are illustrative and not restrictive. Accordingly, it should be understood that, although steps of various processes or methods may be shown and described as being in a sequence or temporal order, the steps of any such processes or methods are not limited to being carried out in any particular sequence or order, absent an indication otherwise. Indeed, the steps in such processes or methods generally may be carried out in various different sequences and orders while still falling within the scope of the present disclosure. Accordingly, it is intended that the scope of patent protection is to be defined by the issued claim(s) rather than the description set forth herein.

Additionally, it is important to note that each term used herein refers to that which an ordinary artisan would understand such term to mean based on the contextual use of such term herein. To the extent that the meaning of a term used herein—as understood by the ordinary artisan based on the contextual use of such term—differs in any way from any particular dictionary definition of such term, it is intended that the meaning of the term as understood by the ordinary artisan should prevail.

Furthermore, it is important to note that, as used herein, "a" and "an" each generally denotes "at least one," but does not exclude a plurality unless the contextual use dictates otherwise. When used herein to join a list of items, "or" denotes "at least one of the items," but does not exclude a plurality of items of the list. Finally, when used herein to join a list of items, "and" denotes "all of the items of the list."

The following detailed description refers to the accompanying drawings. Wherever possible, the same reference numbers are used in the drawings and the following description to refer to the same or similar elements. While many embodiments of the disclosure may be described, modifications, adaptations, and other implementations are possible. For example, substitutions, additions, or modifications may be made to the elements illustrated in the drawings, and the methods described herein may be modified by substituting, reordering, or adding stages to the disclosed methods. Accordingly, the following detailed description does not limit the disclosure. Instead, the proper scope of the disclosure is defined by the claims found herein and/or issuing here from. The present disclosure contains headers. It should be understood that these headers are used as references and are not to be construed as limiting upon the subjected matter disclosed under the header.

The present disclosure includes many aspects and features. Moreover, while many aspects and features relate to, and are described in the context of facilitating enhanced perception of ambiance soundstage and imaging in headphones as well as frequency and phase response linearization of in-ear monitors, embodiments of the present disclosure are not limited to use only in this context.

In general, the method disclosed herein may be performed by one or more computing devices. For example, in some embodiments, the method may be performed by a server computer in communication with one or more client devices over a communication network such as, for example, the Internet. In some other embodiments, the method may be performed by one or more of at least one server computer, at least one client device, at least one network device, at least one sensor and at least one actuator. Examples of the one or more client devices and/or the server computer may include, a desktop computer, a laptop computer, a tablet computer, a personal digital assistant, a portable electronic device, a wearable computer, a smart phone, an Internet of Things (IoT) device, a smart electrical appliance, a video game console, a rack server, a super-computer, a mainframe computer, mini-computer, micro-computer, a storage server, an application server (e.g., a mail server, a web server, a real-time communication server, an FTP server, a virtual server, a proxy server, a DNS server etc.), a quantum computer, and so on. Further, one or more client devices and/or the server computer may be configured for executing a software application such as, for example, but not limited to, an operating system (e.g., Windows, Mac OS, Unix, Linux, Android, etc.) in order to provide a user interface (e.g., GUI, touch-screen based interface, voice based interface, gesture based interface etc.) for use by the one or more users and/or a network interface for communicating with other devices over a communication network. Accordingly, the server computer may include a processing device configured for performing data processing tasks such as, for example, but not limited to, analyzing, identifying, determining, generating, transforming, calculating, computing, compressing, decompressing, encrypting, decrypting, scrambling, splitting, merging, interpolating, extrapolating, redacting, anonymizing, encoding and decoding. Further, the server computer may include a communication device configured for communicating with one or more external devices. The one or more external devices may include, for example, but are not limited to, a client device, a third party database, public database, a private database and so on. Further, the communication device may be configured for communicating with the one or more external devices over one or more communication channels. Further, the one or more communication channels may include a wireless communication channel and/or a wired communication channel. Accordingly, the communication device may be configured for performing one or more of transmitting and receiving of information in electronic form. Further, the server computer may include a storage device configured for performing data storage and/or data retrieval operations. In general, the storage device may be configured for providing reliable storage of digital information. Accordingly, in some embodiments, the storage device may be based on technologies such as, but not limited to, data compression, data backup, data redundancy, deduplication, error correction, data fingerprinting, role based access control, and so on.

Further, one or more steps of the method disclosed herein may be initiated, maintained, controlled and/or terminated based on a control input received from one or more devices operated by one or more users such as, for example, but not limited to, an end user, an admin, a service provider, a service consumer, an agent, a broker and a representative thereof. Further, the user as defined herein may refer to a human, an animal or an artificially intelligent being in any state of existence, unless stated otherwise, elsewhere in the present disclosure. Further, in some embodiments, the one or more users may be required to successfully perform authentication in order for the control input to be effective. In general, a user of the one or more users may perform authentication based on the possession of a secret human readable secret data (e.g., username, password, passphrase, PIN, secret question, secret answer etc.) and/or possession of a machine readable secret data (e.g., encryption key, decryption key, bar codes, etc.) and/or or possession of one or more embodied characteristics unique to the user (e.g., biometric variables such as, but not limited to, fingerprint, palm-print, voice characteristics, behavioral characteristics, facial features, iris pattern, heart rate variability, evoked potentials, brain waves, and so on) and/or possession of a unique device (e.g., a device with a unique physical and/or chemical and/or biological characteristic, a hardware device with a unique serial number, a network device with a unique IP/MAC address, a telephone with a unique phone number, a smartcard with an authentication token stored thereupon, etc.). Accordingly, the one or more steps of the method may include communicating (e.g., transmitting and/or receiving) with one or more sensor devices and/or one or more actuators in order to perform authentication. For example, the one or more steps may include receiving, using the communication device, the secret human readable data from an input device such as, for example, a keyboard, a keypad, a touch-screen, a microphone, a camera and so on. Likewise, the one or more steps may include receiving, using the communication device, the one or more embodied characteristics from one or more biometric sensors.

Further, one or more steps of the method may be automatically initiated, maintained and/or terminated based on one or more predefined conditions. In an instance, the one or more predefined conditions may be based on one or more contextual variables. In general, the one or more contextual variables may represent a condition relevant to the performance of the one or more steps of the method. The one or more contextual variables may include, for example, but are not limited to, location, time, identity of a user associated with a device (e.g., the server computer, a client device etc.) corresponding to the performance of the one or more steps, physical state and/or physiological state and/or psychological state of the user, physical state (e.g., motion, direction of motion, orientation, speed, velocity, acceleration, trajectory, etc.) of the device corresponding to the performance of the one or more steps and/or semantic content of data associated with the one or more users. Accordingly, the one or more steps may include communicating with one or more sensors and/or one or more actuators associated with the one or more contextual variables. For example, the one or more sensors may include, but are not limited to, a timing device (e.g., a real-time clock), a location sensor (e.g., a GPS receiver, a GLONASS receiver, an indoor location sensor etc.), a biometric sensor (e.g., a fingerprint sensor), and a device state sensor (e.g., a power sensor, a voltage/current sensor, a switch-state sensor, a usage sensor, etc. associated with the device corresponding to performance of the or more steps).

Further, the one or more steps of the method may be performed one or more number of times. Additionally, the one or more steps may be performed in any order other than as exemplarily disclosed herein, unless explicitly stated otherwise, elsewhere in the present disclosure. Further, two or more steps of the one or more steps may, in some embodiments, be simultaneously performed, at least in part. Further, in some embodiments, there may be one or more time gaps between performance of any two steps of the one or more steps.

Further, in some embodiments, the one or more predefined conditions may be specified by the one or more users. Accordingly, the one or more steps may include receiving, using the communication device, the one or more predefined conditions from one or more and devices operated by the one or more users. Further, the one or more predefined conditions may be stored in the storage device. Alternatively, and/or additionally, in some embodiments, the one or more predefined conditions may be automatically determined, using the processing device, based on historical data corresponding to performance of the one or more steps. For example, the historical data may be collected, using the storage device, from a plurality of instances of performance of the method. Such historical data may include performance actions (e.g., initiating, maintaining, interrupting, terminating, etc.) of the one or more steps and/or the one or more contextual variables associated therewith. Further, machine learning may be performed on the historical data in order to determine the one or more predefined conditions. For instance, machine learning on the historical data may determine a correlation between one or more contextual variables and performance of the one or more steps of the method. Accordingly, the one or more predefined conditions may be generated, using the processing device, based on the correlation.

Further, one or more steps of the method may be performed at one or more spatial locations. For instance, the method may be performed by a plurality of devices interconnected through a communication network. Accordingly, in an example, one or more steps of the method may be performed by a server computer. Similarly, one or more steps of the method may be performed by a client computer. Likewise, one or more steps of the method may be performed by an intermediate entity such as, for example, a proxy server. For instance, one or more steps of the method may be performed in a distributed fashion across the plurality of devices in order to meet one or more objectives. For example, one objective may be to provide load balancing between two or more devices. Another objective may be to restrict a location of one or more of an input data, an output data and any intermediate data therebetween corresponding to one or more steps of the method. For example, in a client-server environment, sensitive data corresponding to a user may not be allowed to be transmitted to the server computer. Accordingly, one or more steps of the method operating on the sensitive data and/or a derivative thereof may be performed at the client device.

Overview

The present disclosure describes methods and systems for facilitating enhanced perception of ambiance, soundstage, and imaging in headphones as well as frequency and phase response linearization of in-ear monitors. Further, the present disclosure describes a novel crossfeed algorithm combined with frequency amplitude matching and phase correction procedures that enhance the perceived ambiance, soundstage, and imaging in headphones as well as a measurement and correction procedure for in-ear monitors that corrects anomalies in both the frequency and time domain. Further, the disclosed method may include three steps that may work regardless of the headphone drivers they are correcting and may lead to a considerable improvement in the perceived sound quality of any headphone and two steps that will work only with in-ear monitors. Through frequency amplitude matching and phase correction, sounds are distinct and separate as the drivers are now working in tandem to provide the most accurate delivery of the stereo field embedded in the sound file, resulting in perfect imaging. Through crossfeed, subtle spatial characteristics embedded in the sound file are now revealed and the soundstage becomes continuous around the head, resulting in heightened realism and a vastly improved impression of space. Through comprehensive in-ear monitor correction, the resulting audio reproduction will be perceived as neutral by the listener. A combination of these methods can perceptually result in increased clarity, more accurate transients, more realistic imaging, and soundstage, and heightened realism.

Amplitude Matching Procedure: The disclosed system may be based on an amplitude matching procedure that effectively linearizes the response of each headphone driver so that they produce exactly the same amplitude domain characteristics. Further, at first, the amplitude matching procedure may include properly calibrating an omnidirectional measurement microphone so that its response is flat in both amplitude and time domains. Once that is complete, the amplitude matching procedure may include placing the microphone directly in the center of the headphone driver as close to it as possible without touching the driver. Further, the amplitude matching procedure may include taking the measurement using a log sweep impulse measurement and export it. Once exported, the amplitude matching procedure may include importing the measurement into an audio workstation, duplicate the measurement and apply a phase reversion function to the duplicated measurement, and finally, convolving the original measurement with the duplicated phase reversed impulse. What is left after performing these steps is a linear phase impulse with information only in the amplitude domain. Further, the steps of the amplitude matching procedure may be repeated for both drivers. Once the amplitude matching procedure is complete for both drivers, load both measurements into an audio workstation and use the amplitude difference function to subtract the left from the right measurement (or vice versa). Now, the amplitude matching procedure may include convolving the difference with either the left or right driver to achieve perfect linearity between drivers. Further, the amplitude matching procedure may include saving the newly convolved impulse with the opposite channel impulse in stereo, this is an amplitude matching impulse.

Phase Correction Procedure: The disclosed system may be based on a phase correction procedure that may include effectively linearizing the response of each headphone driver to zero phase shift at any frequency. Further, at first, the phase correction procedure may include properly calibrating an omnidirectional measurement microphone so that its response is flat in both amplitude and time domains. Once that is complete, the phase correction procedure may include placing the microphone directly in the center of the headphone driver as close to it as possible without touching the driver (measurement for amplitude matching can be used here as it contains relevant phase information). Once exported, the phase correction procedure may include importing the measurement into an audio workstation, duplicating the measurement and applying an inverse amplitude function to the duplicated measurement, and finally, convolving the original measurement with the duplicated amplitude inverted impulse. What is left after performing these steps is an impulse with only phase information and zero change in the amplitude domain. Further, the steps of the phase correction procedure may be repeated for both drivers. Once the phase correction procedure is complete, both driver's new phase-only impulse responses may be taken and a phase reversion function may be applied to both of them and save them as a stereo file. This is a phase correction impulse.

Extra Procedure: Further, an individual may also consolidate the two correction filters into one because they both contain information in only amplitude or time domains. To combine the filters, the disclosed method may include importing the amplitude correction and the phase correction for the left channel into an audio workstation, convolving the two correction filters, and saving them as a mono impulse. Further, the same may be performed for the right channel. Further, the disclosed method may include taking the left and right consolidated correction filters and saving them as a stereo impulse. This is a master correction filter that can be loaded into any stereo convolution plugin for use.

Further, the disclosed system may be based on a crossfeed simulation algorithm for headphones. Further, crossfeed is a natural phenomenon when listening to audio through a stereo speaker set up. With any speaker set up, audio naturally travels from the left speaker to the left ear and the right speaker to the right ear. In addition, the audio travels from each speaker to opposite ears with a very short time delay. Headphones do not naturally produce crossfeed as the left headphone is coupled to the left ear and the right headphone to the right ear. Through digital signal processing, the disclosed system may be configured for sending a copy of each channel to the opposite ear at a slight time delay with each crossfeed channel being filtered with 24 dB/Octave low pass linear phase FIR filters, attenuating the single at 1600 Hz. The filter serves two purposes. First and foremost, the filter simulates the shadow effect of the head as may naturally be seen in a real free-field stereo environment with two speakers. The second purpose of the filter, which is a byproduct of the aforementioned natural phenomenon, is to eliminate high-frequency comb filtering which occurs when two signals arrive out of phase (which occurs when there is a time delay in the two signals). By attenuating the high frequencies of the crossfeed signal by a sufficient amount, the comb filtering effect dissipates to a large degree. The delay in the lower frequencies does not cause comb filtering because they have longer wavelengths and are essential to getting the desired effect of stereo free-field simulation. The delay of the signal is determined by the distance and angle of speakers to the listener. Most professional acousticians recommend an equilateral triangle between the listener and the speaker. Most professionally designed studios accommodate two sets of speaker distances to the listener; 3-6 ft near-field monitoring and 6-12 ft mid to far-field monitoring. In this case, a 6 ft distance is used for the ideal setup. To determine the time delay from the left speaker to the right ear or from the right speaker to the left ear an average distance from the left ear to the right ear is assigned, in this case, it is defined as 6 inches. Now a triangle may be drawn from either speaker to both ears. For example, the left speaker is 6 ft away from the left ear and the left ear is 6 inches away from the right ear. The angle from the left speaker to the left ear to the right ear is 120 degrees. Through simple geometry, the remainder of the triangle may be filled. The remaining side is equal to approximately 6.265 feet. Another caveat that must be considered is sound diffraction. Sound travels around an object much like an ocean wave moves around a rock. In this case, the sound may travel to the opposite ear at a greater time delay than if it were to travel directly through the head. In order to find the distance traveled from speaker to ear, average head proportions are defined. The distance may be defined from point of first sound incidence (the first wave to strike the head) to the opposite ear from the speaker as 6 inches. 6 inches may be subtracted from the original distance of 6.265 feet which gives us 5.765 feet. Assuming the average shape of the human head is roughly circular and that the distance traveled may be roughly semi-circular, the distance from the first sound incidence around the head to the ear may be calculated. To do this, the previously defined 6 inches from point of first sound incidence to ear is plugged into the formula ½(ΠD). This gives a perimeter of 9.42 inches or 0.79 feet. Add this number to 5.765 to get a distance of 6.555 feet. The difference between the two sides is 0.555 feet and, converted to time (divided by the speed of sound 1.125 ft/ms), 0.491 ms. This may be a crossfeed delay time. The perceptual and subjective result of this invention is a more complete soundstage. Headphones traditionally sound as if they emit sound directly into the right and left ears with a center channel (the sum of mono elements from left and right channels). With the implementation of this crossfeed algorithm, sounds are now able to move continuously from right to left with no apparent gaps in the perceived stereo field. There is a large number of potential uses for the disclosed system because all professionally mastered audio (including but not limited to music, soundtracks for movies, and video game audio) is produced on a stereo setup. The crossfeed algorithm only requires a 4-way convolution plugin to run the filters associated with it. It could be made widely available to consumers of all of the aforementioned mediums. This disclosed system brings us closer than ever to hearing the true intention of the creators behind the audio as the consumer can now more clearly hear what is going on in the mix. In summary, the disclosed system may be based on the crossfeed algorithm that simulates sound propagation in an ideal free-field stereo environment. The crossfeed algorithm consists of the two direct left and right signals going to the left and right ears as well as an additional left and right signal sent to opposite ears at a time delay of 0.491 ms with a 24 dB/Octave low pass linear phase FIR filter, attenuating the signal at 1600 Hz.

Further, the present disclosure describes a measurement and correction procedure to linearize in-ear monitors in both the frequency and time domain. The first step is to place the in-ear monitor in a spot where it is stable and secure without covering the main acoustic shield or other ports. Next, place a reference-grade measurement microphone as close as possible to the main acoustic shield of the in-ear monitor. To simulate the coupling of the in-ear monitor to the ear, use any adhesive and wrap it around both the in-ear monitor and the measurement microphone, connecting the two together. Now the in-ear monitor is ready to be measured with a series of log sweep impulse measurements. In order to increase the significance of the data, take multiple 'reseat' measurements of the in-ear monitor until satisfied (30 is the recommended minimum). Once the measurements have been completed and the data gathered, take a vector average (any function that can convert the raw data into an average in both the frequency and time domains) of the measurements and export the result as an impulse file. This is the true perceptual profile of the in-ear monitor. At this stage, if measurements were taken in a noisy environment, it may be wise to trim the impulse by way of frequency-dependent windowing or manual time-based trimming methods. Now, import the reference impulse into any audio workstation for linearization. Because this impulse measurement technique is directly comparable to measured free field sound from speakers, there is no need for a compensation curve other than an optional band-limiting filter and subsonic filter for low frequencies outside of the audible range. In short, the amplitude and phase of the reference impulse should be inverted such that the resulting convolution of the reference impulse with the new correction impulse is a flat response (0 dB deviation across the audible frequency range and 0 degrees of phase shift). Some in-ear monitors are incapable of producing sub frequencies (<60 Hz) without substantial distortion. In the case of an in-ear monitor with relatively poor distortion performance in the sub frequencies as compared to the rest of the audible range, it will be up to the user to determine the response that leads to ideal performance.

Further, the measurement and correction procedure to linearize in-ear monitors in both the frequency and time domain can be combined with both the frequency and phase matching procedures as well as the crossfeed algorithm in order to produce a more comprehensive in-ear monitor linearization.

Further, the present disclosure describes the potential for synergy between methods, systems, apparatuses, and devices for facilitating enhanced perception of ambiance, soundstage, and imaging in headphones and comprehensive in-ear monitor correction with active noise cancellation technology. Further, the headphones with enhanced ambiance, soundstage, and imaging or the in-ear monitors that have been corrected comprehensively may implement the active noise cancellation technology. Further, the headphones may be active noise-canceling headphones. In that case, the headphones may have maximized their dynamic range (by reducing the noise floor with noise cancellation) which enhances the auditory system's detail retrieval because more information embedded in the audio file is now above the noise floor. This complements the crossfeed algorithm especially because both the algorithm and the comprehensive in-ear monitor correction fundamentally expose details embedded in the audio file, but now the details are clearer because the background noise of the environment is not competing with the audio file. In addition, the frequency amplitude matching and phase correction procedures complement the crossfeed algorithm and the comprehensive in-ear monitor correction (making detail retrieval and the overall listening experience even more precise) and should have no problems with the addition of active noise-canceling technology.

Further, the disclosed system may be configured for facilitating enhanced perception of ambiance, soundstage, and imaging in headphones as well as frequency and phase response linearization of in-ear monitors that uses motion data of the user to enhance the experience and simulate the free-field more accurately.

Further, the disclosed method may include the specific amplitude matching procedure and phase correction procedure to linearize the headphone in both amplitude and time domain.

Further, the disclosed system may be based on the crossfeed simulation algorithm for headphones. Further, the crossfeed algorithm consists of the two direct left and right signals going to the left and right ears as well as an additional left and right signal sent to opposite ears at a time delay of 0.491 ms with a 24 dB/Octave low pass linear phase FIR filter, attenuating the signal at 1600 Hz.

FIG. 1 is an illustration of an online platform 100 consistent with various embodiments of the present disclosure. By way of non-limiting example, the online platform 100 to enable facilitating enhanced perception of ambiance soundstage and imaging in headphones, as well as frequency and phase linearization of in-ear monitors, may be hosted on a centralized server 102, such as, for example, a cloud computing service. The centralized server 102 may communicate with other network entities, such as, for example, a mobile device 106 (such as a smartphone, a laptop, a tablet computer, etc.), other electronic devices 110 (such as desktop computers, server computers, etc.), databases 114, sensors 116, and an audio device 118 (such as a headphone, an in-ear monitor, etc.) over a communication network 104, such as, but not limited to, the Internet. Further, users of the online platform 100 may include relevant parties such as, but not limited to, end-users, administrators, service providers, service consumers, and so on. Accordingly, in some instances, electronic devices operated by the one or more relevant parties may be in communication with the platform.

A user 112, such as the one or more relevant parties, may access online platform 100 through a web based software application or browser. The web based software application may be embodied as, for example, but not be limited to, a website, a web application, a desktop application, and a mobile application compatible with a computing device 200.

Figure 2:
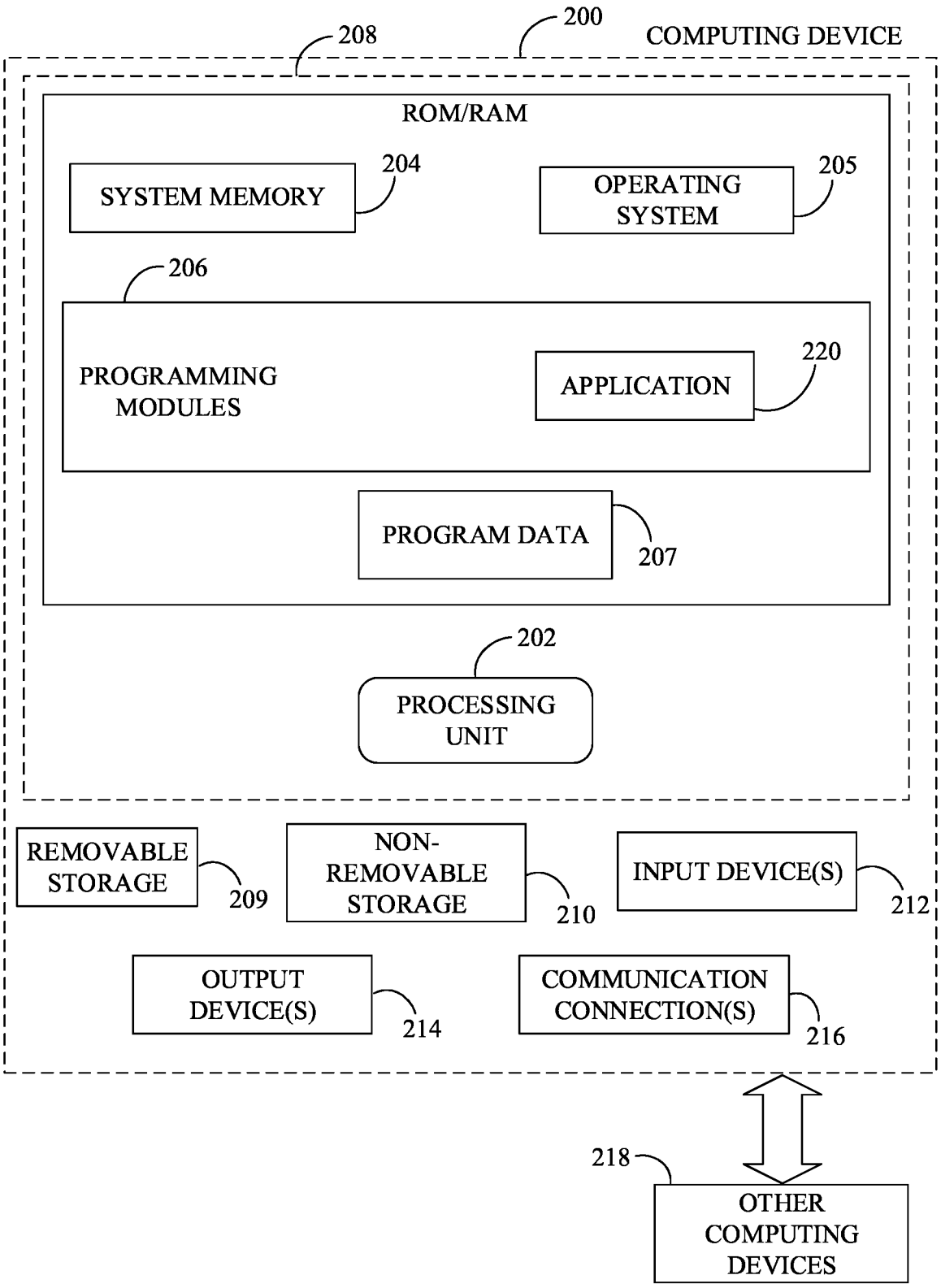
FIG. 2 is a block diagram of a computing device for implementing the methods disclosed herein, in accordance with some embodiments.

With reference to FIG. 2, a system consistent with an embodiment of the disclosure may include a computing device or cloud service, such as computing device 200. In a basic configuration, computing device 200 may include at least one processing unit 202 and a system memory 204. Depending on the configuration and type of computing device, system memory 204 may comprise, but is not limited to, volatile (e.g., random-access memory (RAM)), non-volatile (e.g., read-only memory (ROM)), flash memory, or any combination. System memory 204 may include operating system 205, one or more programming modules 206, and may include a program data 207. Operating system 205, for example, may be suitable for controlling computing device 200's operation. In one embodiment, programming modules 206 may include image-processing module, machine learning module. Furthermore, embodiments of the disclosure may be practiced in conjunction with a graphics library, other operating systems, or any other application program and is not limited to any particular application or system. This basic configuration is illustrated in FIG. 2 by those components within a dashed line 208.

Computing device 200 may have additional features or functionality. For example, computing device 200 may also include additional data storage devices (removable and/or non-removable) such as, for example, magnetic disks, optical disks, or tape. Such additional storage is illustrated in FIG. 2 by a removable storage 209 and a non-removable storage 210. Computer storage media may include volatile and non-volatile, removable and non-removable media implemented in any method or technology for storage of information, such as computer-readable instructions, data structures, program modules, or other data. System memory 204, removable storage 209, and non-removable storage 210 are all computer storage media examples (i.e., memory storage.) Computer storage media may include, but is not limited to, RAM, ROM, electrically erasable read-only memory (EEPROM), flash memory or other memory technology, CD-ROM, digital versatile disks (DVD) or other optical storage, magnetic cassettes, magnetic tape, magnetic disk storage or other magnetic storage devices, or any other medium which can be used to store information and which can be accessed by computing device 200. Any such computer storage media may be part of device 200. Computing device 200 may also have input device(s) 212 such as a keyboard, a mouse, a pen, a sound input device, a touch input device, a location sensor, a camera, a biometric sensor, etc. Output device(s) 214 such as a display, speakers, a printer, etc. may also be included. The aforementioned devices are examples and others may be used.

Computing device 200 may also contain a communication connection 216 that may allow device 200 to communicate with other computing devices 218, such as over a network in a distributed computing environment, for example, an intranet or the Internet. Communication connection 216 is one example of communication media. Communication media may typically be embodied by computer readable instructions, data structures, program modules, or other data in a modulated data signal, such as a carrier wave or other transport mechanism, and includes any information delivery media. The term "modulated data signal" may describe a signal that has one or more characteristics set or changed in such a manner as to encode information in the signal. By way of example, and not limitation, communication media may include wired media such as a wired network or direct-wired connection, and wireless media such as acoustic, radio frequency (RF), infrared, and other wireless media. The term computer readable media as used herein may include both storage media and communication media.

As stated above, a number of program modules and data files may be stored in system memory 204, including operating system 205. While executing on processing unit 202, programming modules 206 (e.g., application 220 such as a media player) may perform processes including, for example, one or more stages of methods, algorithms, systems, applications, servers, databases as described above. The aforementioned process is an example, and processing unit 202 may perform other processes. Other programming modules that may be used in accordance with embodiments of the present disclosure may include machine learning applications.

Generally, consistent with embodiments of the disclosure, program modules may include routines, programs, components, data structures, and other types of structures that may perform particular tasks or that may implement particular abstract data types. Moreover, embodiments of the disclosure may be practiced with other computer system configurations, including hand-held devices, general purpose graphics processor-based systems, multiprocessor systems, microprocessor-based or programmable consumer electronics, application specific integrated circuit-based electronics, minicomputers, mainframe computers, and the like. Embodiments of the disclosure may also be practiced in distributed computing environments where tasks are performed by remote processing devices that are linked through a communications network. In a distributed computing environment, program modules may be located in both local and remote memory storage devices.

Furthermore, embodiments of the disclosure may be practiced in an electrical circuit comprising discrete electronic elements, packaged or integrated electronic chips containing logic gates, a circuit utilizing a microprocessor, or on a single chip containing electronic elements or microprocessors. Embodiments of the disclosure may also be practiced using other technologies capable of performing logical operations such as, for example, AND, OR, and NOT, including but not limited to mechanical, optical, fluidic, and quantum technologies. In addition, embodiments of the disclosure may be practiced within a general-purpose computer or in any other circuits or systems.

Embodiments of the disclosure, for example, may be implemented as a computer process (method), a computing system, or as an article of manufacture, such as a computer program product or computer readable media. The computer program product may be a computer storage media readable by a computer system and encoding a computer program of instructions for executing a computer process. The computer program product may also be a propagated signal on a carrier readable by a computing system and encoding a computer program of instructions for executing a computer process. Accordingly, the present disclosure may be embodied in hardware and/or in software (including firmware, resident software, micro-code, etc.). In other words, embodiments of the present disclosure may take the form of a computer program product on a computer-usable or computer-readable storage medium having computer-usable or computer-readable program code embodied in the medium for use by or in connection with an instruction execution system. A computer-usable or computer-readable medium may be any medium that can contain, store, communicate, propagate, or transport the program for use by or in connection with the instruction execution system, apparatus, or device.

The computer-usable or computer-readable medium may be, for example but not limited to, an electronic, magnetic, optical, electromagnetic, infrared, or semiconductor system, apparatus, device, or propagation medium. More specific computer-readable medium examples (a non-exhaustive list), the computer-readable medium may include the following: an electrical connection having one or more wires, a portable computer diskette, a random-access memory (RAM), a read-only memory (ROM), an erasable programmable read-only memory (EPROM or Flash memory), an optical fiber, and a portable compact disc read-only memory (CD-ROM). Note that the computer-usable or computer-readable medium could even be paper or another suitable medium upon which the program is printed, as the program can be electronically captured, via, for instance, optical scanning of the paper or other medium, then compiled, interpreted, or otherwise processed in a suitable manner, if necessary, and then stored in a computer memory.

Embodiments of the present disclosure, for example, are described above with reference to block diagrams and/or operational illustrations of methods, systems, and computer program products according to embodiments of the disclosure. The functions/acts noted in the blocks may occur out of the order as shown in any flowchart. For example, two blocks shown in succession may in fact be executed substantially concurrently or the blocks may sometimes be executed in the reverse order, depending upon the functionality/acts involved.

While certain embodiments of the disclosure have been described, other embodiments may exist. Furthermore, although embodiments of the present disclosure have been described as being associated with data stored in memory and other storage mediums, data can also be stored on or read from other types of computer-readable media, such as secondary storage devices, like hard disks, solid state storage (e.g., USB drive), or a CD-ROM, a carrier wave from the Internet, or other forms of RAM or ROM. Further, the disclosed methods' stages may be modified in any manner, including by reordering stages and/or inserting or deleting stages, without departing from the disclosure.

Figure 3:
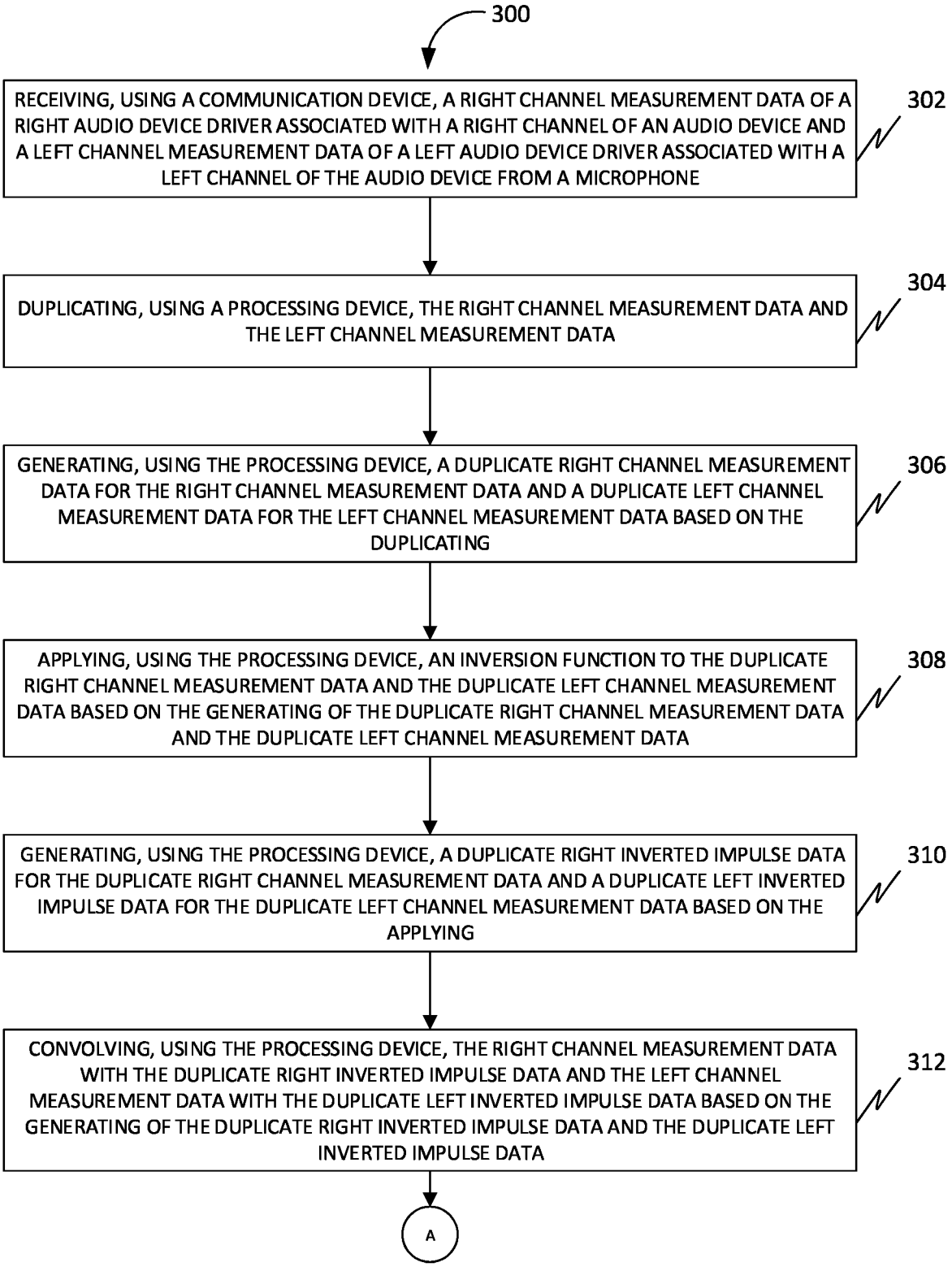
FIG. 3 is a flowchart of a method for facilitating enhanced perception of ambiance soundstage and imaging in audio devices, in accordance with some embodiments.

FIG. 3 is a flowchart of a method 300 for facilitating enhanced perception of ambiance soundstage and imaging in audio devices, in accordance with some embodiments.

Further, the method 300 may include a step 302 of receiving, using a communication device (such as a communication device 802), a right channel measurement data of a right audio device driver associated with a right channel of an audio device and a left channel measurement data of a left audio device driver associated with a left channel of the audio device from a microphone.

Further, the method 300 may include a step 304 of duplicating, using a processing device (such as a processing device 804), the right channel measurement data and the left channel measurement data.

Further, the method 300 may include a step 306 of generating, using the processing device, a duplicate right channel measurement data for the right channel measurement data and a duplicate left channel measurement data for the left channel measurement data based on the duplicating.

Further, the method 300 may include a step 308 of applying, using the processing device, an inversion function to the duplicate right channel measurement data and the duplicate left channel measurement data based on the generating of the duplicate right channel measurement data and the duplicate left channel measurement data.

Further, the method 300 may include a step 310 of generating, using the processing device, a duplicate right inverted impulse data for the duplicate right channel measurement data and a duplicate left inverted impulse data for the duplicate left channel measurement data based on the applying.

Further, the method 300 may include a step 312 of convolving, using the processing device, the right channel measurement data with the duplicate right inverted impulse data and the left channel measurement data with the duplicate left inverted impulse data based on the generating of the duplicate right inverted impulse data and the duplicate left inverted impulse data.

Figure 4:
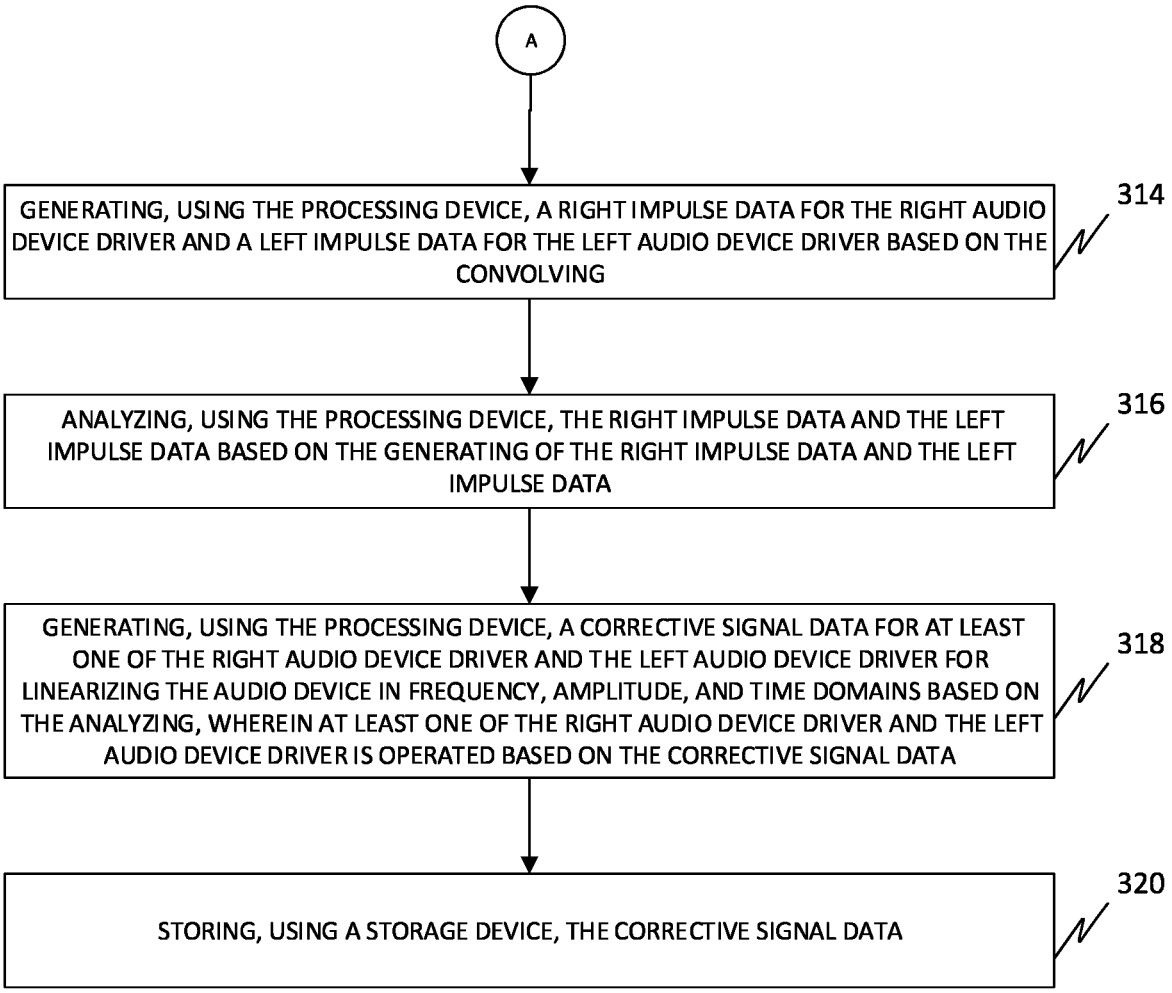
FIG. 4 is a continuation flowchart of FIG. 3.

FIG. 4 is a continuation flowchart of FIG. 3.

Further, the method 300 may include a step 314 of generating, using the processing device, a right impulse data for the right audio device driver and a left impulse data for the left audio device driver based on the convolving.

Further, the method 300 may include a step 316 of analyzing, using the processing device, the right impulse data and the left impulse data based on the generating of the right impulse data and the left impulse data.

Further, the method 300 may include a step 318 of generating, using the processing device, a corrective signal data for one or more of the right audio device driver and the left audio device driver for linearizing the audio device in amplitude and time domains based on the analyzing. Further, one or more of the right audio device driver and the left audio device driver is operated based on the corrective signal data.

Further, the method 300 may include a step 320 of storing, using a storage device (such as a storage device 806), the corrective signal data.

Further, in some embodiments, the applying may include applying a phase reversion function to the duplicate right channel measurement data and the duplicate left channel measurement data. Further, the duplicate right inverted impulse data may include a duplicate right phase reversed impulse data and the duplicate left inverted impulse data may include a duplicate left phase reversed impulse data. Further, the generating of the duplicate right inverted impulse data and the duplicate left inverted impulse data may include generating the duplicate right phase reversed impulse data and the duplicate left phase reversed impulse data based on the applying of the phase reversion function. Further, the convolving may include convolving the right channel measurement data with the duplicate right phase reversed impulse data and the left channel measurement data with the duplicate left phase reversed impulse data based on the generating of the duplicate right phase reversed impulse data and the duplicate left phase reversed impulse data. Further, the right impulse data may include a right amplitude impulse data and the left impulse data may include a left amplitude impulse data. Further, the generating of the right impulse data and the left impulse data may include generating the right amplitude impulse data and the left amplitude impulse data based on the convolving of the right channel measurement data with the duplicate right phase reversed impulse data and the left channel measurement data with the duplicate left phase reversed impulse data.

Further, in some embodiments, the right amplitude impulse data and the left amplitude impulse data may include at least one information associated with an amplitude domain. Further, the analyzing of the right impulse data and the left impulse data may include applying an amplitude difference function to the right amplitude impulse data and the left amplitude impulse data. Further, the right amplitude impulse data may be subtracted from the left amplitude impulse data based on the applying of the amplitude difference function. Further, the corrective signal data may include a frequency matching impulse data. Further, the generating of the corrective signal data may include generating the frequency matching impulse data based on the applying of the amplitude difference function.

Further, in some embodiments, the applying may include applying an inverse amplitude function to the duplicate right channel measurement data and the duplicate left channel measurement data. Further, the duplicate right inverted impulse data may include a duplicate right amplitude inverted impulse data and the duplicate left inverted impulse data may include a duplicate left amplitude inverted impulse data. Further, the generating of the duplicate right inverted impulse data and the duplicate left inverted impulse data may include generating the duplicate right amplitude inverted impulse data and the duplicate left amplitude inverted impulse data based on the applying of the inverse amplitude function. Further, the convolving may include convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data. Further, the right impulse data may include a right phase impulse data and the left impulse data may include a left phase impulse data. Further, the generating of the right impulse data and the left impulse data may include generating the right phase impulse data and the left phase impulse data based on the convolving of the right channel measurement data with the duplicate right amplitude inverted impulse data and the left channel measurement data with the duplicate left amplitude inverted impulse data.

Further, in some embodiments, the right phase impulse data and the left phase impulse data may include at least one information associated with a phase domain. Further, the analyzing of the right impulse data and the left impulse data may include applying a phase reversion function to the right phase impulse data and the left phase impulse data. Further, the corrective signal data may include a phase matching impulse data. Further, the generating of the corrective signal data may include generating of the phase matching impulse data based on the applying of the phase reversion function.

Further, in some embodiments, the applying may include applying a phase reversion function to the duplicate right channel measurement data and the duplicate left channel measurement data. Further, the applying may include applying an inverse amplitude function to the duplicate right channel measurement data and the duplicate left channel measurement data. Further, the duplicate right inverted impulse data may include a duplicate right phase reversed impulse data and a duplicate right amplitude inverted impulse data and the duplicate left inverted impulse data may include a duplicate left phase reversed impulse data and a duplicate left amplitude inverted impulse data. Further, the generating of the duplicate right inverted impulse data and the duplicate left inverted impulse data may include generating the duplicate right phase reversed impulse data and the duplicate left phase reversed impulse data based on the applying of the phase reversion function to the duplicate right channel measurement data and the duplicate left channel measurement data. Further, the generating of the duplicate right inverted impulse data and the duplicate left inverted impulse data may include generating the duplicate right amplitude inverted impulse data and the duplicate left amplitude inverted impulse data based on the applying of the inverse amplitude function to the duplicate right channel measurement data and the duplicate left channel measurement data. Further, the convolving may include convolving the right channel measurement data with the duplicate right phase reversed impulse data and the left channel measurement data with the duplicate left phase reversed impulse data based on the generating of the duplicate right phase reversed impulse data and the duplicate left phase reversed impulse data. Further, the convolving may include convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data. Further, the right impulse data may include a right amplitude impulse data and a right phase impulse data. Further, the left impulse data may include a left amplitude impulse data and a left phase impulse data. Further, the generating of the right impulse data and the left impulse data may include generating the right amplitude impulse data and the left amplitude impulse data based on the convolving of the right channel measurement data with the duplicate right phase reversed impulse data and the left channel measurement data with the duplicate left phase reversed impulse data. Further, the generating of the right impulse data and the left impulse data may include generating the right phase impulse data and the left phase impulse data based on the convolving of the right channel measurement data with the duplicate right amplitude inverted impulse data and the left channel measurement data with the duplicate left amplitude inverted impulse data.

Further, in some embodiments, the right amplitude impulse data and the left amplitude impulse data may include at least one information associated with an amplitude domain. Further, the right phase impulse data and the left phase impulse data may include at least one information associated with a phase domain. Further, the analyzing of the right impulse data and the left impulse data may include applying an amplitude difference function to the right amplitude impulse data and the left amplitude impulse data. Further, the right amplitude impulse data may be subtracted from the left amplitude impulse data based on the applying of the amplitude difference function. Further, the analyzing of the right impulse data and the left impulse data may include applying a phase reversion function to the right phase impulse data and the left phase impulse data. Further, the corrective signal data may include a frequency matching impulse data and a phase matching impulse data. Further, the generating of the corrective signal data may include generating the frequency matching impulse data based on the applying of the amplitude difference function. Further, the generating of the corrective signal data may include generating of the phase matching impulse data based on the applying of the phase reversion function. Further, the storing of the corrective signal data may include storing the frequency matching impulse data and the phase matching impulse data.

Figure 5:
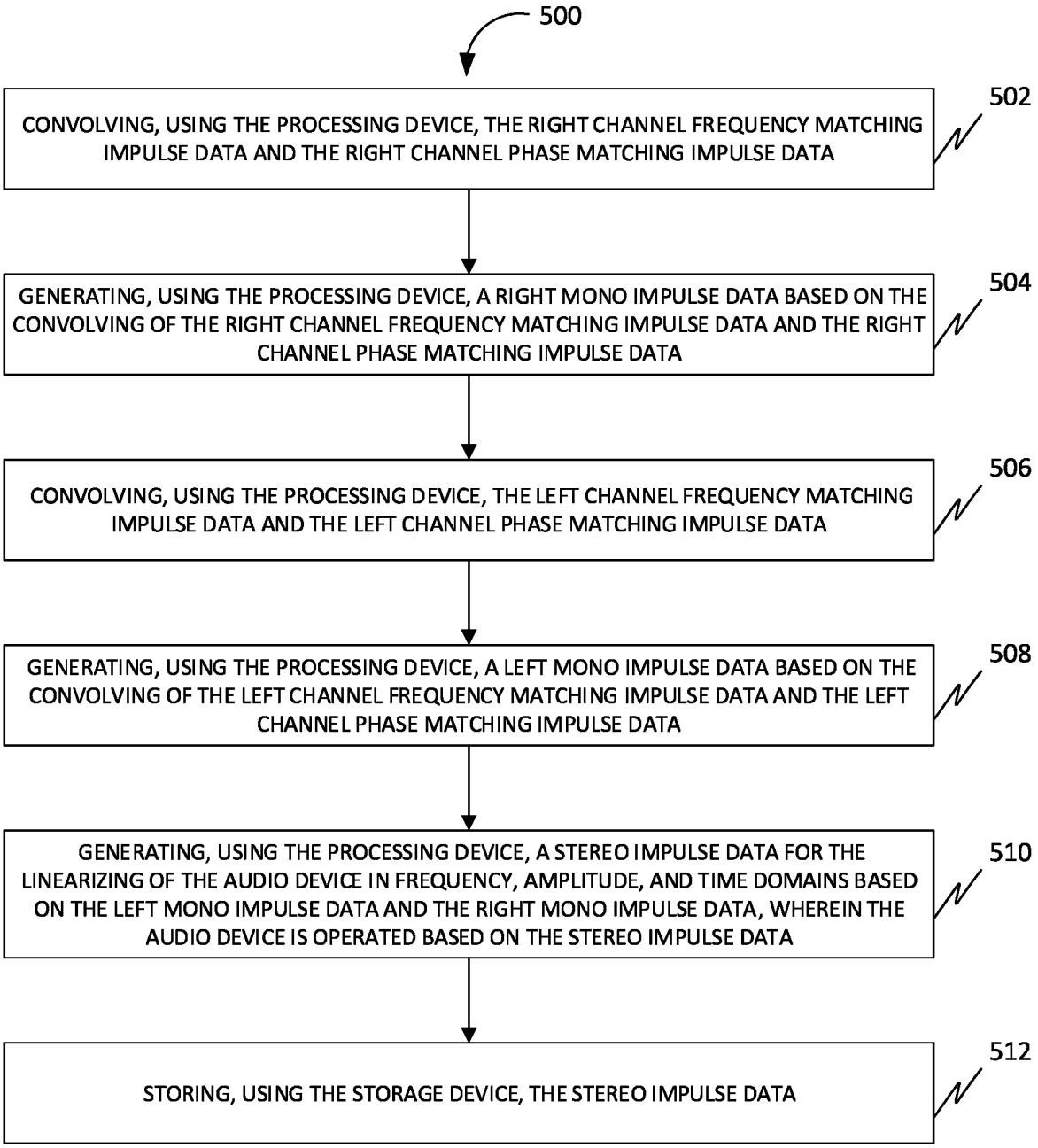
FIG. 5 is a flowchart of a method for facilitating enhanced perception of ambiance soundstage and imaging in audio devices in which the method further may include generating a stereo impulse data, in accordance with some embodiments.

FIG. 5 is a flowchart of a method 500 for facilitating enhanced perception of ambiance soundstage and imaging in audio devices in which the method 500 further may include generating a stereo impulse data, in accordance with some embodiments. Further, the frequency matching impulse data may include a right channel frequency matching impulse data for the right audio device driver and a left channel frequency matching impulse data for the left audio device driver. Further, the phase matching impulse data may include a right channel phase matching impulse data for the right audio device driver and a left channel phase matching impulse data for the left audio device driver. Further, the method 500 may include a step 502 of convolving, using the processing device, the right channel frequency matching impulse data and the right channel phase matching impulse data. Further, the method 500 may include a step 504 of generating, using the processing device, a right mono impulse data based on the convolving of the right channel frequency matching impulse data and the right channel phase matching impulse data. Further, the method 500 may include a step 506 of convolving, using the processing device, the left channel frequency matching impulse data and the left channel phase matching impulse data. Further, the method 500 may include a step 508 of generating, using the processing device, a left mono impulse data based on the convolving of the left channel frequency matching impulse data and the left channel phase matching impulse data. Further, the method 500 may include a step 510 of generating, using the processing device, a stereo impulse data for the linearizing of the audio device in frequency, amplitude, and time domains based on the left mono impulse data and the right mono impulse data. Further, the audio device may be operated based on the stereo impulse data. Further, the method 500 may include a step 512 of storing, using the storage device, the stereo impulse data.

Figure 6:
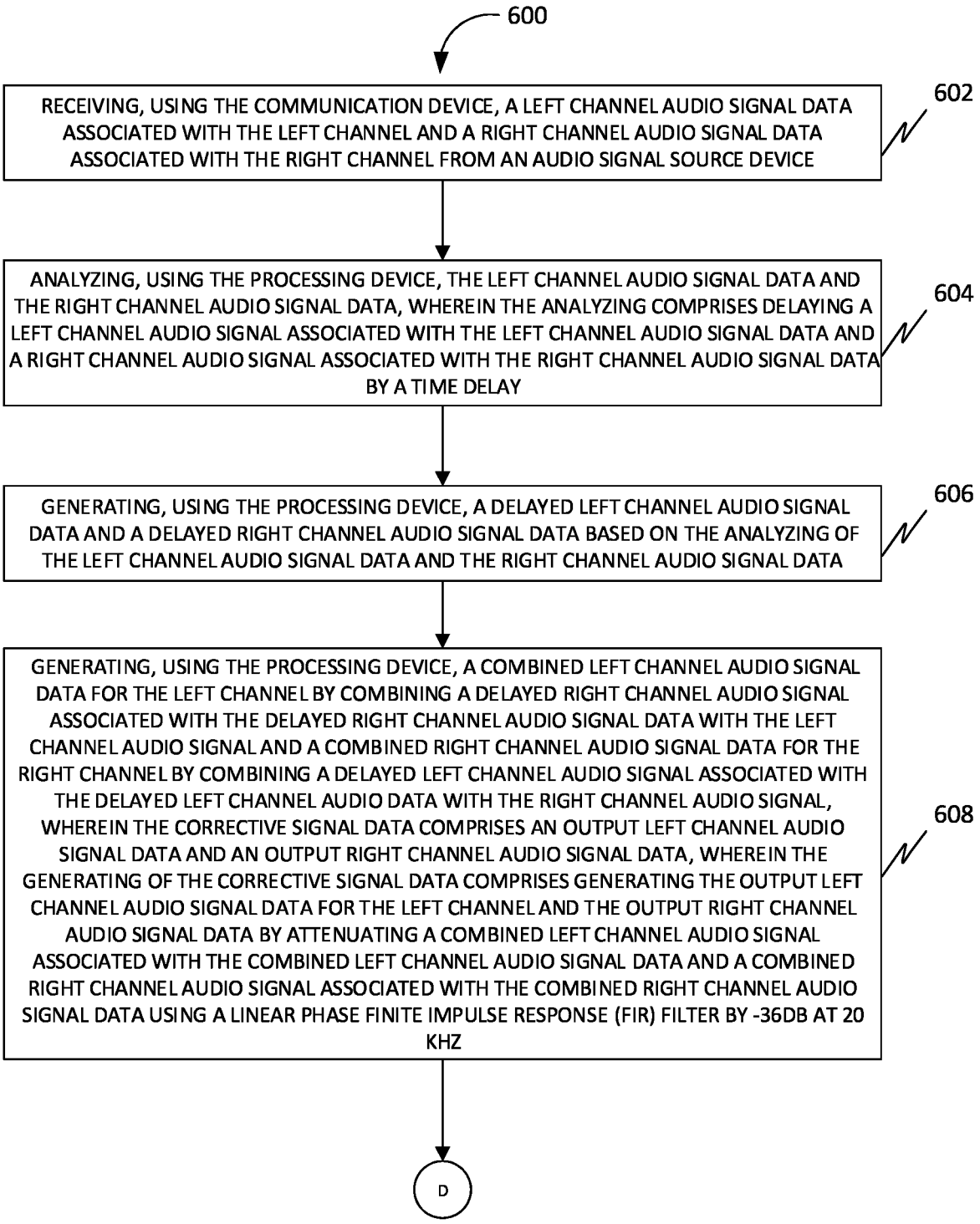
FIG. 6 is a flowchart of a method for facilitating enhanced perception of ambiance soundstage and imaging in audio devices in which the method further may include transmitting the output left channel audio signal data to the left audio device driver and the output right channel audio signal data to the right audio device driver, in accordance with some embodiments.

FIG. 6 is a flowchart of a method 600 for facilitating enhanced perception of ambiance soundstage and imaging in audio devices in which the method 600 further may include transmitting the output left channel audio signal data to the left audio device driver and the output right channel audio signal data to the right audio device driver, in accordance with some embodiments. Further, the method 600 may include a step 602 of receiving, using the communication device, a left channel audio signal data associated with the left channel and a right channel audio signal data associated with the right channel from an audio signal source device. Further, the method 600 may include a step 604 of analyzing, using the processing device, the left channel audio signal data and the right channel audio signal data. Further, the analyzing may include delaying a left channel audio signal associated with the left channel audio signal data and a right channel audio signal associated with the right channel audio signal data by a time delay. Further, the method 600 may include a step 606 of generating, using the processing device, a delayed left channel audio signal data and a delayed right channel audio signal data based on the analyzing of the left channel audio signal data and the right channel audio signal data. Further, the method 600 may include a step 608 of generating, using the processing device, a combined left channel audio signal data for the left channel by combining a delayed right channel audio signal associated with the delayed right channel audio signal data with the left channel audio signal and a combined right channel audio signal data for the right channel by combining a delayed left channel audio signal associated with the delayed left channel audio data with the right channel audio signal. Further, the corrective signal data may include an output left channel audio signal data and an output right channel audio signal data. Further, the generating of the corrective signal data may include generating the output left channel audio signal data for the left channel and the output right channel audio signal data by attenuating a combined left channel audio signal associated with the combined left channel audio signal data and a combined right channel audio signal associated with the combined right channel audio signal data using a 24 dB/Octave low pass linear phase finite impulse response (FIR) filter. Further, the method 600 may include a step 610 of transmitting, using the communication device, the output left channel audio signal data to the left audio device driver and the output right channel audio signal data to the right audio device driver. Further, the left audio device driver may be operated based on the output left channel audio signal data and the right audio device driver may be operated based on the left audio device driver.

Figure 7:
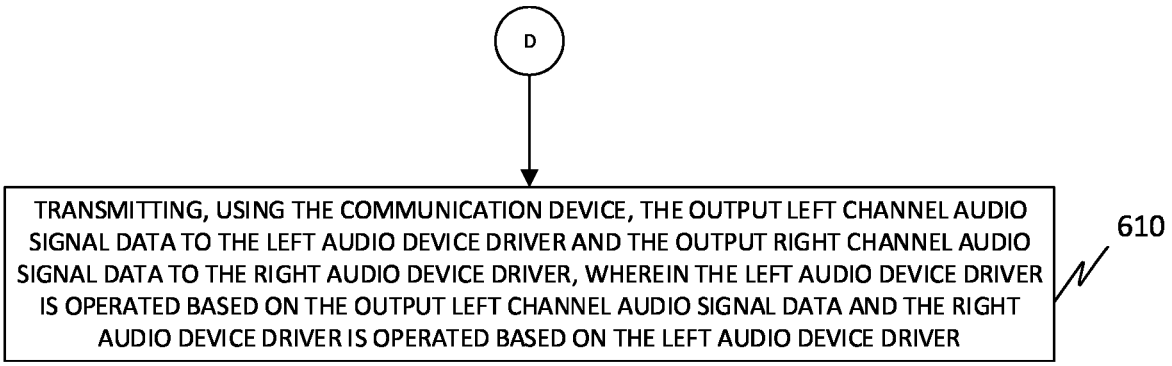
FIG. 7 is a continuation flowchart of FIG. 6.

FIG. 7 is a continuation flowchart of FIG. 6.

Figure 8:
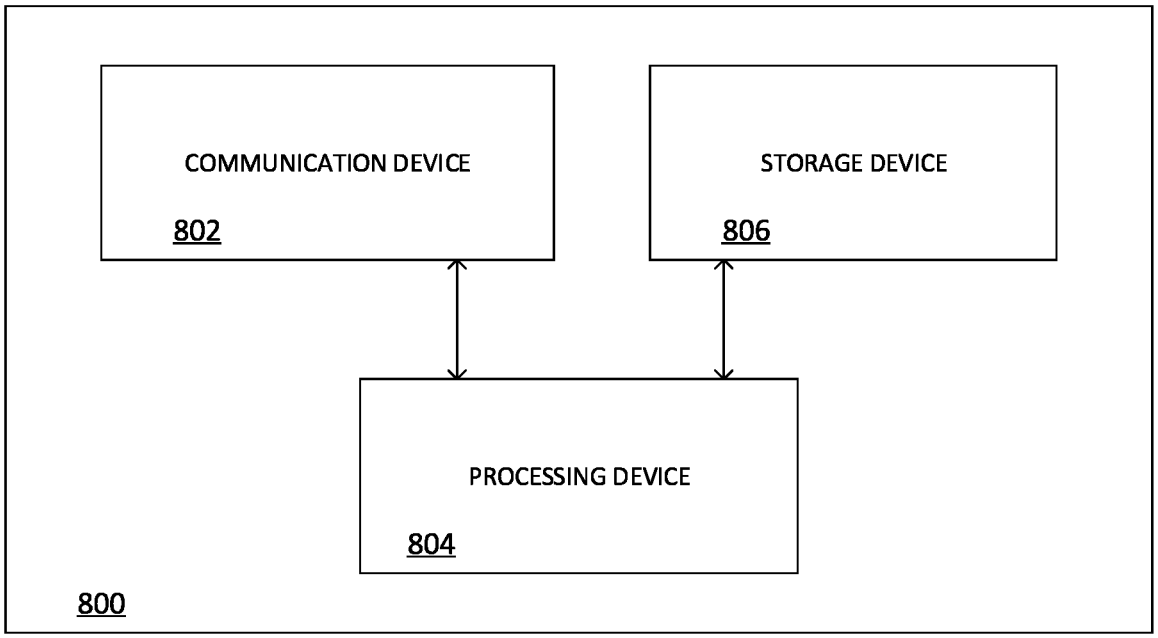
FIG. 8 is a block diagram of a system for facilitating enhanced perception of ambiance soundstage and imaging in audio devices, in accordance with some embodiments.

FIG. 8 is a block diagram of a system 800 for facilitating enhanced perception of ambiance soundstage and imaging in audio devices, in accordance with some embodiments. The system 800 may include a communication device 802, a processing device 804, and a storage device 806.

Further, the communication device 802 may be configured for performing a step of receiving a right channel measurement data of a right audio device driver associated with a right channel of an audio device and a left channel measurement data of a left audio device driver associated with a left channel of the audio device from a microphone.

The processing device 804 may be communicatively coupled with the communication device 802.

Further, the processing device 804 may be configured for performing a step of duplicating the right channel measurement data and the left channel measurement data.

Further, the processing device 804 may be configured for performing a step of generating a duplicate right channel measurement data for the right channel measurement data and a duplicate left channel measurement data for the left channel measurement data based on the duplicating.

Further, the processing device 804 may be configured for performing a step of applying an inversion function to the duplicate right channel measurement data and the duplicate left channel measurement data based on the generating of the duplicate right channel measurement data and the duplicate left channel measurement data.

Further, the processing device 804 may be configured for performing a step of generating a duplicate right inverted impulse data for the duplicate right channel measurement data and a duplicate left inverted impulse data for the duplicate left channel measurement data based on the applying.

Further, the processing device 804 may be configured for performing a step of convolving the right channel measurement data with the duplicate right inverted impulse data and the left channel measurement data with the duplicate left inverted impulse data based on the generating of the duplicate right inverted impulse data and the duplicate left inverted impulse data.

Further, the processing device 804 may be configured for performing a step of generating a right impulse data for the right audio device driver and a left impulse data for the left audio device driver based on the convolving.

Further, the processing device 804 may be configured for performing a step of analyzing the right impulse data and the left impulse data based on the generating of the right impulse data and the left impulse data.

Further, the processing device 804 may be configured for performing a step of generating a corrective signal data for one or more of the right audio device driver and the left audio device driver for linearizing the audio device in amplitude and time domains based on the analyzing. Further, one or more of the right audio device driver and the left audio device driver is operated based on the corrective signal data.

The storage device 806 may be communicatively coupled with the processing device 804.

Further, the storage device 806 may be configured for performing a step of storing the corrective signal data.

Further, in some embodiments, the applying may include applying a phase reversion function to the duplicate right channel measurement data and the duplicate left channel measurement data. Further, the duplicate right inverted impulse data may include a duplicate right phase reversed impulse data and the duplicate left inverted impulse data may include a duplicate left phase reversed impulse data. Further, the generating of the duplicate right inverted impulse data and the duplicate left inverted impulse data may include generating the duplicate right phase reversed impulse data and the duplicate left phase reversed impulse data based on the applying of the phase reversion function. Further, the convolving may include convolving the right channel measurement data with the duplicate right phase reversed impulse data and the left channel measurement data with the duplicate left phase reversed impulse data based on the generating of the duplicate right phase reversed impulse data and the duplicate left phase reversed impulse data. Further, the right impulse data may include a right amplitude impulse data and the left impulse data may include a left amplitude impulse data. Further, the generating of the right impulse data and the left impulse data may include generating the right amplitude impulse data and the left amplitude impulse data based on the convolving of the right channel measurement data with the duplicate right phase reversed impulse data and the left channel measurement data with the duplicate left phase reversed impulse data.

Further, in some embodiments, the right amplitude impulse data and the left amplitude impulse data may include at least one information associated with an amplitude domain. Further, the analyzing of the right impulse data and the left impulse data may include applying an amplitude difference function to the right amplitude impulse data and the left amplitude impulse data. Further, the right amplitude impulse data may be subtracted from the left amplitude impulse data based on the applying of the amplitude difference function. Further, the corrective signal data may include a frequency matching impulse data. Further, the generating of the corrective signal data may include generating the frequency matching impulse data based on the applying of the amplitude difference function.

Further, in some embodiments, the applying may include applying an inverse amplitude function to the duplicate right channel measurement data and the duplicate left channel measurement data. Further, the duplicate right inverted impulse data may include a duplicate right amplitude inverted impulse data and the duplicate left inverted impulse data may include a duplicate left amplitude inverted impulse data. Further, the generating of the duplicate right inverted impulse data and the duplicate left inverted impulse data may include generating the duplicate right amplitude inverted impulse data and the duplicate left amplitude inverted impulse data based on the applying of the inverse amplitude function. Further, the convolving may include convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data. Further, the right impulse data may include a right phase impulse data and the left impulse data may include a left phase impulse data. Further, the generating of the right impulse data and the left impulse data may include generating the right phase impulse data and the left phase impulse data based on the convolving of the right channel measurement data with the duplicate right amplitude inverted impulse data and the left channel measurement data with the duplicate left amplitude inverted impulse data.

Further, in some embodiments, the right phase impulse data and the left phase impulse data may include at least one information associated with a phase domain. Further, the analyzing of the right impulse data and the left impulse data may include applying a phase reversion function to the right phase impulse data and the left phase impulse data. Further, the corrective signal data may include a phase matching impulse data. Further, the generating of the corrective signal data may include generating of the phase matching impulse data based on the applying of the phase reversion function.

Further, in some embodiments, the applying may include applying a phase reversion function to the duplicate right channel measurement data and the duplicate left channel measurement data. Further, the applying may include applying an inverse amplitude function to the duplicate right channel measurement data and the duplicate left channel measurement data. Further, the duplicate right inverted impulse data may include a duplicate right phase reversed impulse data and a duplicate right amplitude inverted impulse data and the duplicate left inverted impulse data may include a duplicate left phase reversed impulse data and a duplicate left amplitude inverted impulse data. Further, the generating of the duplicate right inverted impulse data and the duplicate left inverted impulse data may include generating the duplicate right phase reversed impulse data and the duplicate left phase reversed impulse data based on the applying of the phase reversion function to the duplicate right channel measurement data and the duplicate left channel measurement data. Further, the generating of the duplicate right inverted impulse data and the duplicate left inverted impulse data may include generating the duplicate right amplitude inverted impulse data and the duplicate left amplitude inverted impulse data based on the applying of the inverse amplitude function to the duplicate right channel measurement data and the duplicate left channel measurement data. Further, the convolving may include convolving the right channel measurement data with the duplicate right phase reversed impulse data and the left channel measurement data with the duplicate left phase reversed impulse data based on the generating of the duplicate right phase reversed impulse data and the duplicate left phase reversed impulse data. Further, the convolving may include convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data. Further, the right impulse data may include a right amplitude impulse data and a right phase impulse data. Further, the left impulse data may include a left amplitude impulse data and a left phase impulse data.

Further, the generating of the right impulse data and the left impulse data may include generating the right amplitude impulse data and the left amplitude impulse data based on the convolving of the right channel measurement data with the duplicate right phase reversed impulse data and the left channel measurement data with the duplicate left phase reversed impulse data. Further, the generating of the right impulse data and the left impulse data may include generating the right phase impulse data and the left phase impulse data based on the convolving of the right channel measurement data with the duplicate right amplitude inverted impulse data and the left channel measurement data with the duplicate left amplitude inverted impulse data.

Further, in some embodiments, the right amplitude impulse data and the left amplitude impulse data may include at least one information associated with an amplitude domain. Further, the right phase impulse data and the left phase impulse data may include at least one information associated with a phase domain. Further, the analyzing of the right impulse data and the left impulse data may include applying an amplitude difference function to the right amplitude impulse data and the left amplitude impulse data. Further, the right amplitude impulse data may be subtracted from the left amplitude impulse data based on the applying of the amplitude difference function. Further, the analyzing of the right impulse data and the left impulse data may include applying a phase reversion function to the right phase impulse data and the left phase impulse data. Further, the corrective signal data may include a frequency matching impulse data and a phase matching impulse data. Further, the generating of the corrective signal data may include generating the frequency matching impulse data based on the applying of the amplitude difference function. Further, the generating of the corrective signal data may include generating of the phase matching impulse data based on the applying of the phase reversion function. Further, the storing of the corrective signal data may include storing the frequency matching impulse data and the phase matching impulse data.

Further, in some embodiments, the frequency matching impulse data may include a right channel frequency matching impulse data for the right audio device driver and a left channel frequency matching impulse data for the left audio device driver. Further, the phase matching impulse data may include a right channel phase matching impulse data for the right audio device driver and a left channel phase matching impulse data for the left audio device driver. Further, the processing device 804 may be configured for convolving the right channel frequency matching impulse data and the right channel phase matching impulse data. Further, the processing device 804 may be configured for generating a right mono impulse data based on the convolving of the right channel frequency matching impulse data and the right channel phase matching impulse data. Further, the processing device 804 may be configured for convolving the left channel frequency matching impulse data and the left channel phase matching impulse data. Further, the processing device 804 may be configured for generating a left mono impulse data based on the convolving of the left channel frequency matching impulse data and the left channel phase matching impulse data. Further, the processing device 804 may be configured for generating a stereo impulse data for the linearizing of the audio device in frequency, amplitude, and time domains based on the left mono impulse data and the right mono impulse data. Further, the audio device may be operated based on the stereo impulse data. Further, the storage device 806 may be configured for storing the stereo impulse data.

Further, in some embodiments, the communication device 802 may be configured for receiving a left channel audio signal data associated with the left channel and a right channel audio signal data associated with the right channel from an audio signal source device. Further, the communication device 802 may be configured for transmitting an output left channel audio signal data to the left audio device driver and an output right channel audio signal data to the right audio device driver. Further, the left audio device driver may be operated based on the output left channel audio signal data and the right audio device driver may be operated based on the left audio device driver. Further, the processing device 804 may be configured for analyzing the left channel audio signal data and the right channel audio signal data. Further, the analyzing may include delaying a left channel audio signal associated with the left channel audio signal data and a right channel audio signal associated with the right channel audio signal data by a time delay. Further, the processing device 804 may be configured for generating a delayed left channel audio signal data and a delayed right channel audio signal data based on the analyzing of the left channel audio signal data and the right channel audio signal data. Further, the processing device 804 may be configured for generating a combined left channel audio signal data for the left channel by combining a delayed right channel audio signal associated with the delayed right channel audio signal data with the left channel audio signal and a combined right channel audio signal data for the right channel by combining a delayed left channel audio signal associated with the delayed left channel audio data with the right channel audio signal. Further, the corrective signal data may include the output left channel audio signal data and the output right channel audio signal data. Further, the generating of the corrective signal data may include generating the output left channel audio signal data for the left channel and the output right channel audio signal data by attenuating a combined left channel audio signal associated with the combined left channel audio signal data and a combined right channel audio signal associated with the combined right channel audio signal data using a 24 dB/Octave low pass linear phase finite impulse response (FIR) filter.

Figure 9:
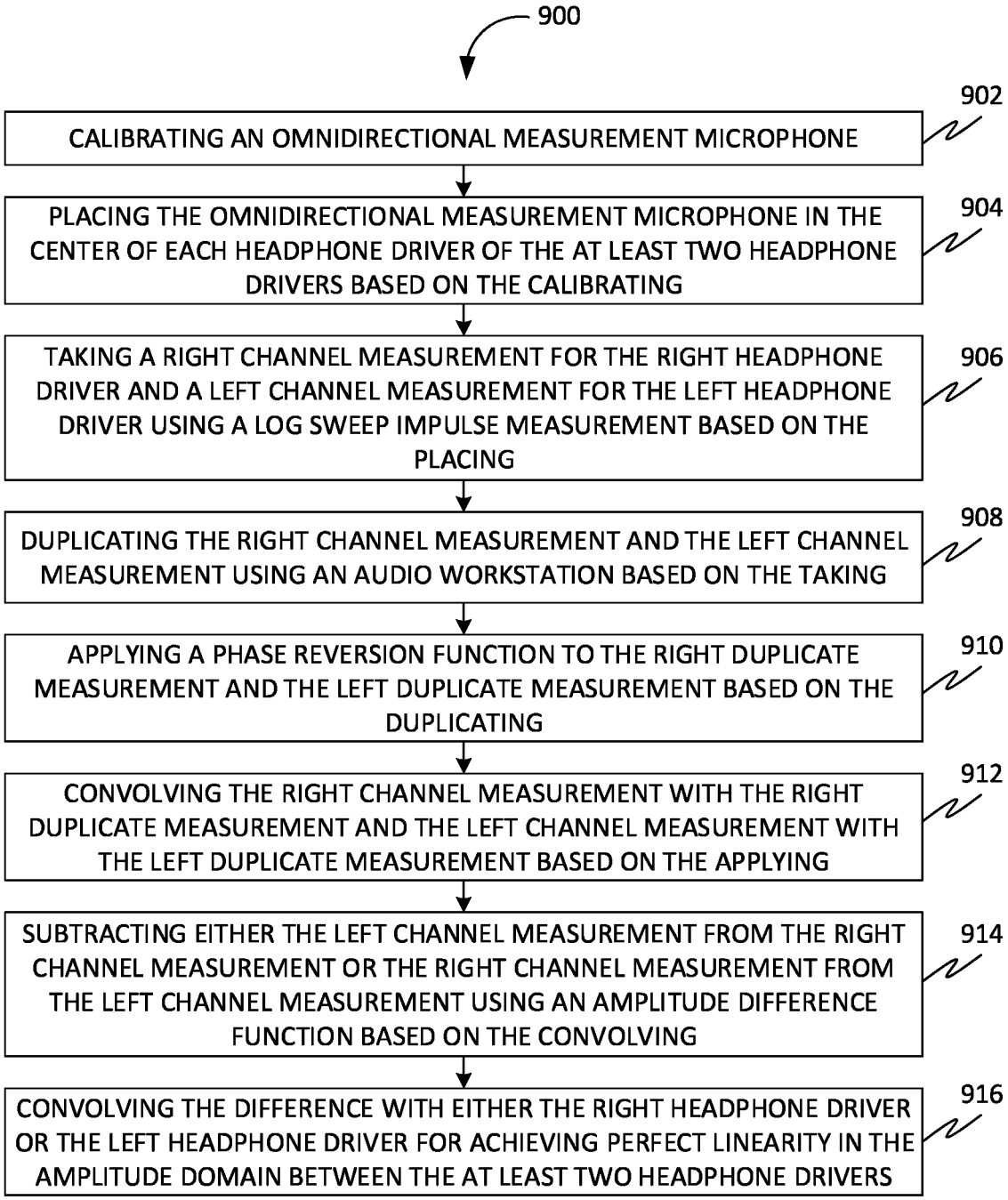
FIG. 9 is a flowchart of a method for facilitating amplitude matching in a headphone, in accordance with some embodiments.

FIG. 9 is a flowchart of a method 900 for facilitating amplitude matching in a headphone, in accordance with some embodiments. Accordingly, at least one step of the method 900 may be executed by the headphone (such as the headphone 118) for facilitating enhanced perception of ambiance, soundstage, and imaging in the headphone. Further, the method 900 for facilitating the amplitude matching may be configured for effectively linearizing a response of each headphone driver of at least two headphone drivers of the headphone. Further, each headphone driver produces the same amplitude domain characteristics based on the linearizing.

Further, at 902, the method 900 may include a step of calibrating an omnidirectional measurement microphone. Further, a response of the omnidirectional measurement microphone may be flat in both amplitude and time domains.

Further, at 904, the method 900 may include a step of placing the omnidirectional measurement microphone in the center of each headphone driver of the at least two headphone drivers based on the calibrating. Further, the omnidirectional measurement microphone may be placed in a close proximity with each headphone driver. Further, the omnidirectional measurement microphone does not touch either headphone driver.

Further, at 906, the method 900 may include a step of taking a right channel measurement for the right headphone driver and a left channel measurement for the left headphone driver using a log sweep impulse measurement based on the placing.

Further, at 908, the method 900 may include a step of duplicating the right channel measurement and the left channel measurement using an audio workstation based on the taking. Further, the duplicating may include generating a right duplicate measurement corresponding to the right channel measurement and a left duplicate measurement corresponding to the left channel measurement.

Further, at 910, the method 900 may include a step of applying a phase reversion function to the right duplicate measurement and the left duplicate measurement based on the duplicating.

Further, at 912, the method 900 may include a step of convolving the right channel measurement with the right duplicate measurement and the left channel measurement with the left duplicate measurement based on the applying. Further, the convolving generates a linear phase impulse associated with the right channel measurement and the left channel measurement. Further, the linear phase impulse may include information in the amplitude domain.

Further, at 914, the method 900 may include a step of subtracting either the left channel measurement from the right channel measurement or the right channel measurement from the left channel measurement using an amplitude difference function based on the convolving. Further, the subtracting may include generating a difference associated with the left channel measurement and the right channel measurement.

Further, at 916, the method 900 may include a step of convolving the difference with either the right headphone driver or the left headphone driver for achieving perfect linearity in the amplitude domain between the at least two headphone drivers.

Figure 10:
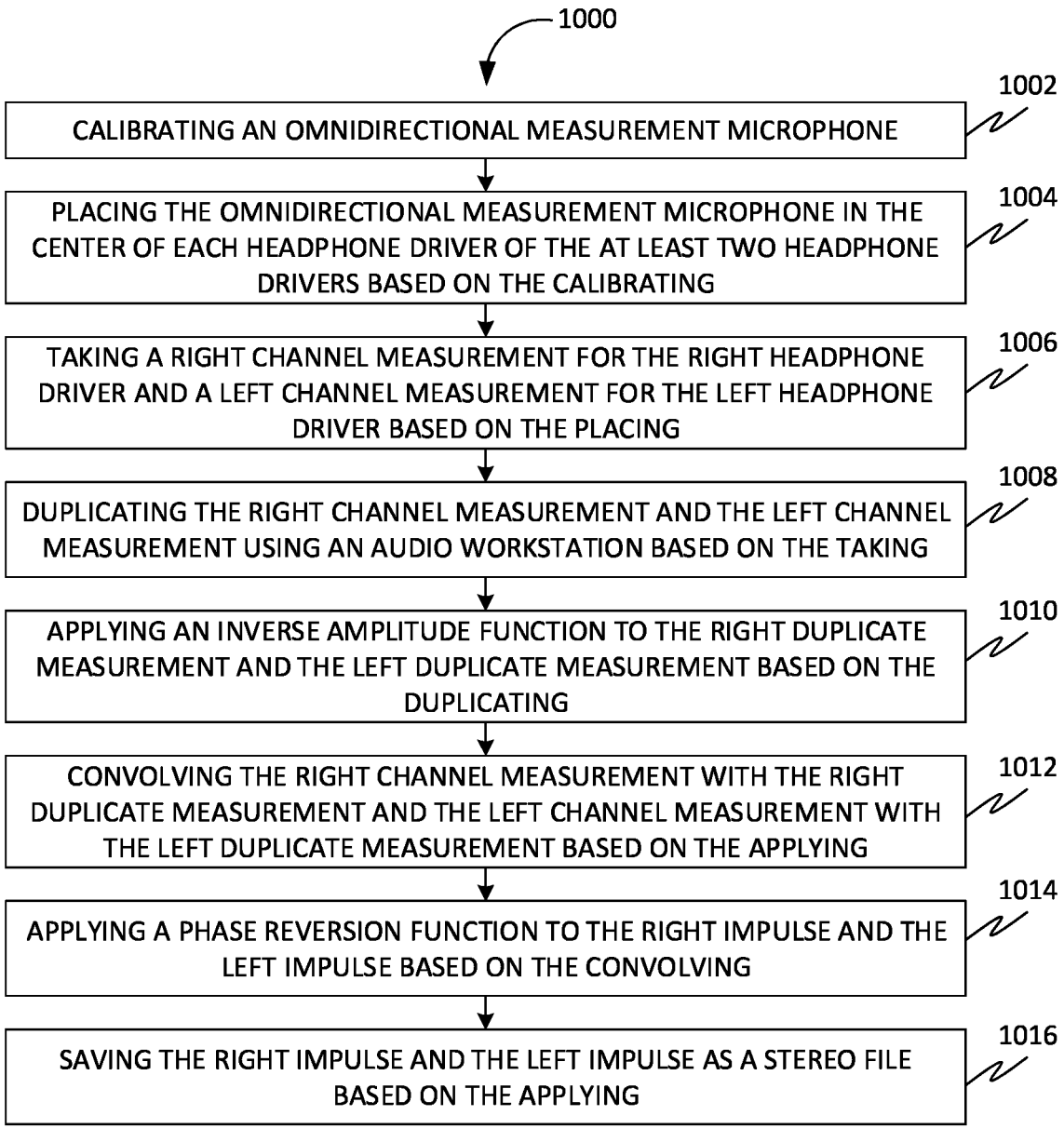
FIG. 10 is a flowchart of a method for facilitating phase correction in a headphone, in accordance with some embodiments.

FIG. 10 is a flowchart of a method 1000 for facilitating phase correction in a headphone, in accordance with some embodiments. Further, at least one step of the method 1000 may be executed by the headphone for facilitating enhanced perception of ambiance, soundstage, and imaging in the headphone. Further, the method 1000 for facilitating the phase correction may be configured for effectively linearizing a response of each headphone driver of the at least two headphone drivers of the headphone for providing a zero phase shift at any frequency. Further, each headphone driver produces no phase anomalies based on the linearizing.

Further, at 1002, the method 1000 may include a step of calibrating an omnidirectional measurement microphone. Further, a response of the omnidirectional measurement microphone may be flat in both amplitude and time domains.

Further, at 1004, the method 1000 may include a step of placing the omnidirectional measurement microphone in the center of each headphone driver of the at least two headphone drivers based on the calibrating. Further, the omnidirectional measurement microphone may be placed in a close proximity with each headphone driver. Further, the omnidirectional measurement microphone does not touch either headphone driver.

Further, at 1006, the method 1000 may include a step of taking a right channel measurement for the right headphone driver and a left channel measurement for the left headphone driver based on the placing.

Further, at 1008, the method 1000 may include a step of duplicating the right channel measurement and the left channel measurement using an audio workstation based on the taking. Further, the duplicating may include generating a right duplicate measurement corresponding to the right channel measurement and a left duplicate measurement corresponding to the left channel measurement.

Further, at 1010, the method 1000 may include a step of applying an inverse amplitude function to the right duplicate measurement and the left duplicate measurement based on the duplicating.

Further, at 1012, the method 1000 may include a step of convolving the right channel measurement with the right duplicate measurement and the left channel measurement with the left duplicate measurement based on the applying. Further, the convolving generates a right impulse associated with the right channel measurement and a left impulse associated with the left channel measurement. Further, both the right impulse and the left impulse may include phase information and zero change in the amplitude domain.

Further, at 1014, the method 1000 may include a step of applying a phase reversion function to the right impulse and the left impulse based on the convolving.

Further, at 1016, the method 1000 may include a step of saving the right impulse and the left impulse as a stereo file based on the applying. Further, the stereo file may be a phase correction impulse.

Figure 11:
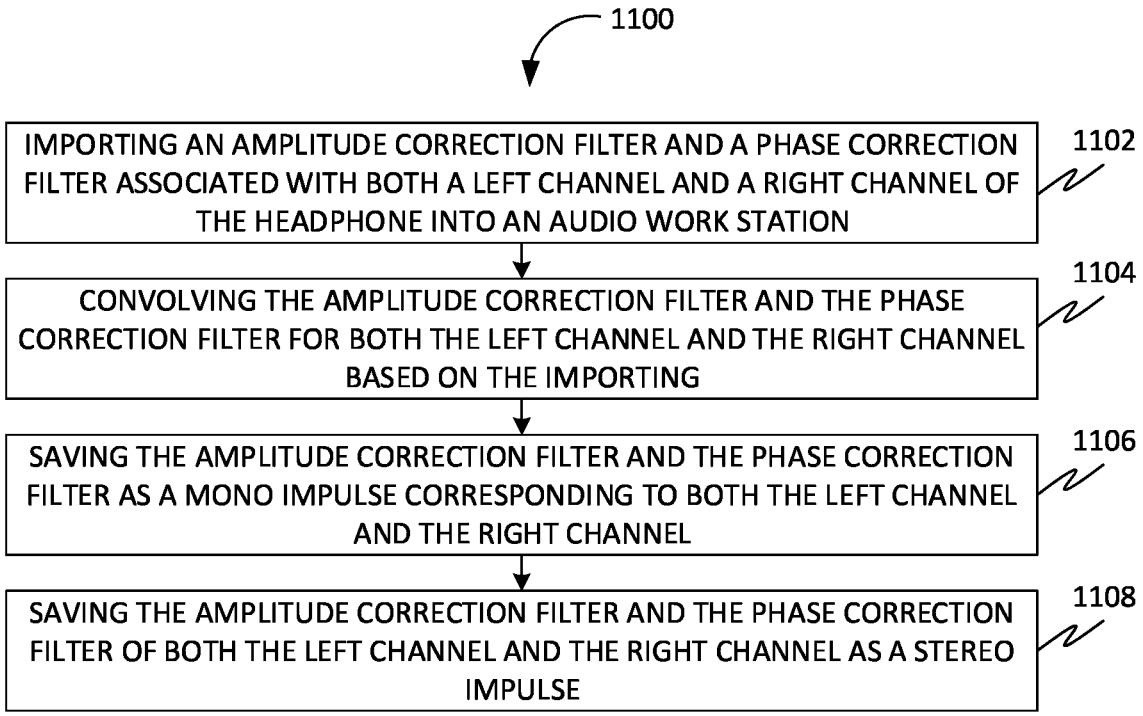
FIG. 11 is a flowchart of a method for facilitating consolidation of correction filters in a headphone, in accordance with some embodiments.

FIG. 11 is a flowchart of a method 1100 for facilitating consolidation of correction filters in a headphone, in accordance with some embodiments. Further, at least one step of the method 1100 may be executed by the headphone for facilitating enhanced perception of ambiance, soundstage, and imaging in the headphone. Further, the method 1100 may be configured for facilitating the consolidating of two correction filters into one filter. Further, each correction filter of the two correction filters may include information in only amplitude or time domain.

Further, at 1102, the method 1100 may include a step of importing an amplitude correction filter and a phase correction filter associated with both a left channel and a right channel of the headphone into an audio workstation.

Further, at 1104, the method 1100 may include a step of convolving the amplitude correction filter and the phase correction filter for both the left channel and the right channel based on the importing.

Further, at 1106, the method 1100 may include a step of saving the amplitude correction filter and the phase correction filter as a mono impulse corresponding to both the left channel and the right channel.

Further, at 1108, the method 1100 may include a step of saving the amplitude correction filter and the phase correction filter of both the left channel and the right channel as a stereo impulse. Further, the stereo impulse may be a master correction filter that may be loaded into any stereo convolution plugin for use.

Figure 12:
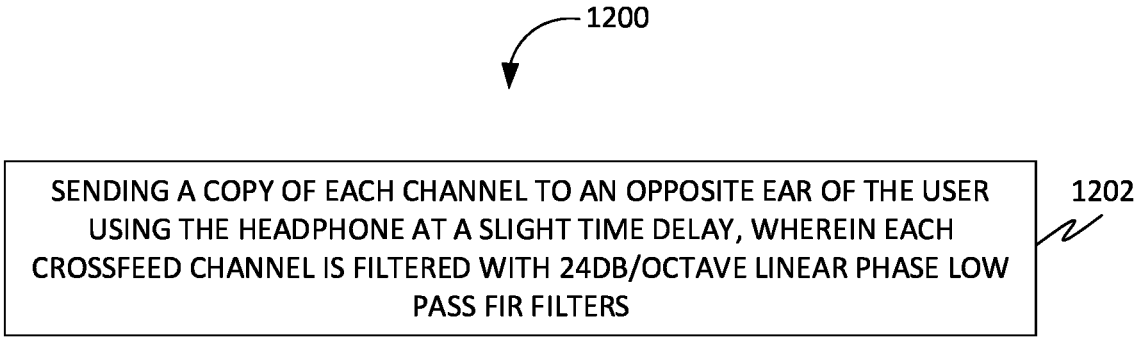
FIG. 12 is a flowchart of a method for facilitating crossfeed in a headphone, in accordance with some embodiments.

FIG. 12 is a flowchart of a method 1200 for facilitating crossfeed in a headphone, in accordance with some embodiments. Further, at least one step of the method 1200 may be executed by the headphone for facilitating enhanced perception of ambiance, soundstage, and imaging in the headphone.

Further, at 1202, the method 1200 may include a step of sending a copy of each channel to an opposite ear of the user using the headphone at a slight time delay. Further, each crossfeed channel may be filtered with 24 dB/Octave linear phase low pass FIR filters. Further, the linear phase FIR low-pass filters attenuate the signal associated with each opposite channel at 1600 Hz.

Figure 13:
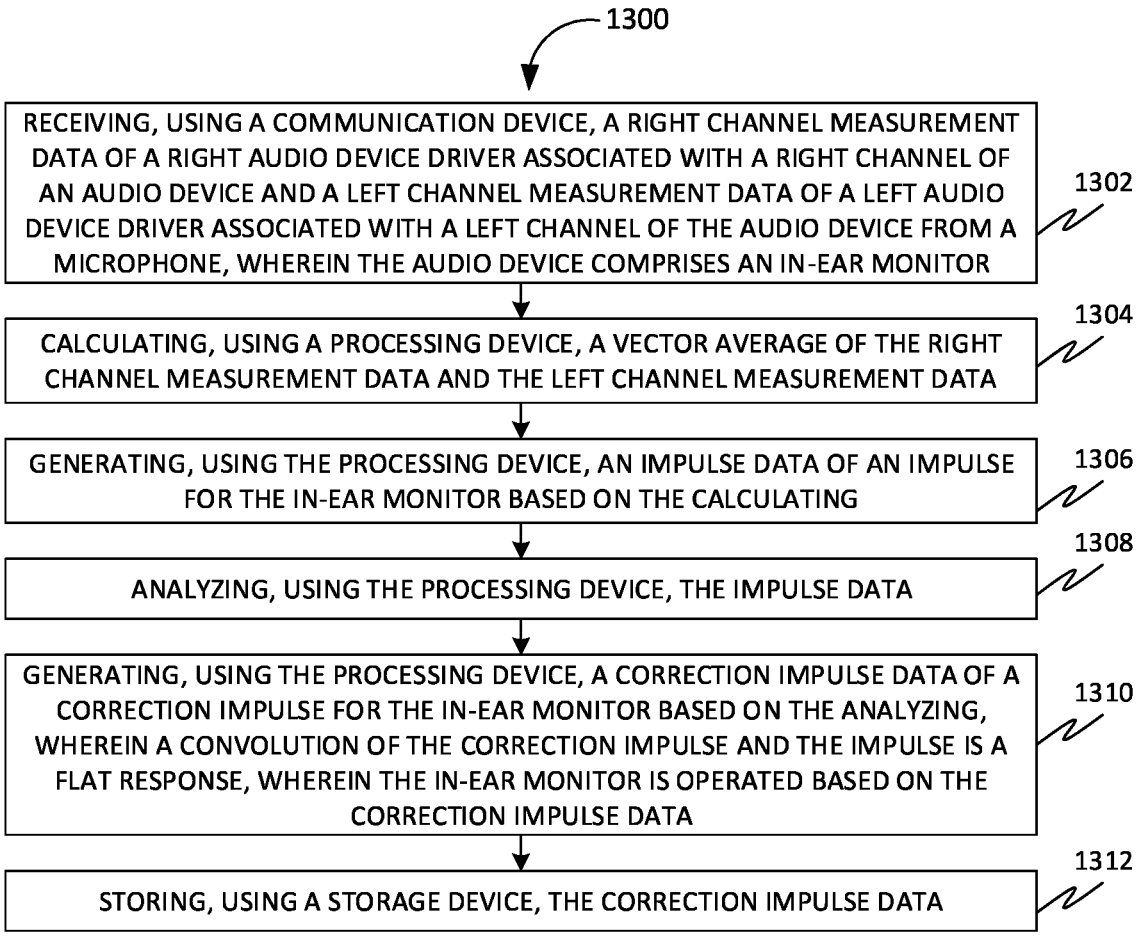
FIG. 13 is a flowchart of a method for facilitating linearizing of audio devices, in accordance with some embodiments.

FIG. 13 is a flowchart of a method 1300 for facilitating linearizing of audio devices, in accordance with some embodiments. Accordingly, the method 1300 may include a step 1302 of receiving, using a communication device, a right channel measurement data of a right audio device driver associated with a right channel of an audio device and a left channel measurement data of a left audio device driver associated with a left channel of the audio device from a microphone. Further, the audio device may include an in-ear monitor. Further, the microphone and the in-ear monitor are coupled together by an adhesive.

Further, the method 1300 may include a step 1304 of calculating, using a processing device, a vector average of the right channel measurement data and the left channel measurement data.

Further, the method 1300 may include a step 1306 of generating, using the processing device, an impulse data of an impulse for the in-ear monitor based on the calculating.

Further, the method 1300 may include a step 1308 of analyzing, using the processing device, the impulse data.

Further, the method 1300 may include a step 1310 of generating, using the processing device, a correction impulse data of a correction impulse for the in-ear monitor based on the analyzing. Further, a convolution of the correction impulse and the impulse is a flat response. Further, the in-ear monitor may be operated based on the correction impulse data.

Further, the method 1300 may include a step 1312 of storing, using a storage device, the correction impulse data.

Further, in some embodiments, the analyzing of the impulse data may include inverting an amplitude and a phase of the impulse of the in-ear monitor. Further, the generating of the correction impulse data may be based on the inverting.

Although the present disclosure has been explained in relation to its preferred embodiment, it is to be understood that many other possible modifications and variations can be made without departing from the spirit and scope of the disclosure.

What is claimed is:

1. A method for facilitating enhanced perception of ambiance, soundstage, and imaging in audio devices, the method comprising:

receiving, using a communication device, a right channel measurement data of a right audio device driver associated with a right channel of an audio device and a left channel measurement data of a left audio device driver associated with a left channel of the audio device from a microphone, wherein the audio device comprises a headphone;

duplicating, using a processing device, the right channel measurement data and the left channel measurement data;

generating, using the processing device, a duplicate right channel measurement data for the right channel measurement data and a duplicate left channel measurement data for the left channel measurement data based on the duplicating;

applying, using the processing device, an inversion function to the duplicate right channel measurement data and the duplicate left channel measurement data based on the generating of the duplicate right channel measurement data and the duplicate left channel measurement data;

generating, using the processing device, a duplicate right inverted impulse data for the duplicate right channel measurement data and a duplicate left inverted impulse data for the duplicate left channel measurement data based on the applying;

convolving, using the processing device, the right channel measurement data with the duplicate right inverted impulse data and the left channel measurement data with the duplicate left inverted impulse data based on the generating of the duplicate right inverted impulse data and the duplicate left inverted impulse data;

generating, using the processing device, a right impulse data for the right audio device driver and a left impulse data for the left audio device driver based on the convolving;

analyzing, using the processing device, the right impulse data and the left impulse data based on the generating of the right impulse data and the left impulse data;

generating, using the processing device, a corrective signal data for at least one of the right audio device driver and the left audio device driver for linearizing the audio device in amplitude and time domains based on the analyzing, wherein at least one of the right audio device driver and the left audio device driver is operated based on the corrective signal data; and storing, using a storage device, the corrective signal data.

2. The method of claim 1, wherein the applying comprises applying a phase reversion function to the duplicate right channel measurement data and the duplicate left channel measurement data, wherein the duplicate right inverted impulse data comprises a duplicate right phase reversed impulse data and the duplicate left inverted impulse data comprises a duplicate left phase reversed impulse data, wherein the generating of the duplicate right inverted impulse data and the duplicate left inverted impulse data comprises generating the duplicate right phase reversed impulse data and the duplicate left phase reversed impulse data based on the applying of the phase reversion function, wherein the convolving comprises convolving the right channel measurement data with the duplicate right phase reversed impulse data and the left channel measurement data with the duplicate left phase reversed impulse data based on the generating of the duplicate right phase reversed impulse data and the duplicate left phase reversed impulse data, wherein the right impulse data comprises a right amplitude impulse data and the left impulse data comprises a left amplitude impulse data, wherein the generating of the right impulse data and the left impulse data comprises generating the right amplitude impulse data and the left amplitude impulse data based on the convolving of the right channel measurement data with the duplicate right phase reversed impulse data and the left channel measurement data with the duplicate left phase reversed impulse data.

3. The method of claim 2, wherein the right amplitude impulse data and the left amplitude impulse data comprises at least one information associated with an amplitude domain, wherein the analyzing of the right impulse data and the left impulse data comprises applying an amplitude difference function to the right amplitude impulse data and the left amplitude impulse data, wherein the right amplitude impulse data is subtracted from the left amplitude impulse data based on the applying of the amplitude difference function, wherein the corrective signal data comprises a frequency matching impulse data, wherein the generating of the corrective signal data comprises generating the frequency matching impulse data based on the applying of the amplitude difference function.

4. The method of claim 1, wherein the applying comprises applying an inverse amplitude function to the duplicate right channel measurement data and the duplicate left channel measurement data, wherein the duplicate right inverted impulse data comprises a duplicate right amplitude inverted impulse data and the duplicate left inverted impulse data comprises a duplicate left amplitude inverted impulse data, wherein the generating of the duplicate right inverted impulse data and the duplicate left inverted impulse data comprises generating the duplicate right amplitude inverted impulse data and the duplicate left amplitude inverted impulse data based on the applying of the inverse amplitude function, wherein the convolving comprises convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data, wherein the right impulse data comprises a right phase impulse data and the left impulse data comprises a left phase impulse data, wherein the generating of the right impulse data and the left impulse data comprises generating the right phase impulse data and the left phase impulse data based on the convolving of the right channel measurement data with the duplicate right amplitude inverted impulse data and the left channel measurement data with the duplicate left amplitude inverted impulse data.

5. The method of claim 4, wherein the right phase impulse data and the left phase impulse data comprises at least one information associated with a phase domain, wherein the analyzing of the right impulse data and the left impulse data comprises applying a phase reversion function to the right phase impulse data and the left phase impulse data, wherein the corrective signal data comprises a phase matching impulse data, wherein the generating of the corrective signal data comprises generating of the phase matching impulse data based on the applying of the phase reversion function.

6. The method of claim 1, wherein the applying comprises:

applying a phase reversion function to the duplicate right channel measurement data and the duplicate left channel measurement data; and applying an inverse amplitude function to the duplicate right channel measurement data and the duplicate left channel measurement data, wherein the duplicate right inverted impulse data comprises a duplicate right phase reversed impulse data and a duplicate right amplitude inverted impulse data and the duplicate left inverted impulse data comprises a duplicate left phase reversed impulse data and a duplicate left amplitude inverted impulse data, wherein the generating of the duplicate right inverted impulse data and the duplicate left inverted impulse data comprises:

generating the duplicate right phase reversed impulse data and the duplicate left phase reversed impulse data based on the applying of the phase reversion function to the duplicate right channel measurement data and the duplicate left channel measurement data; and generating the duplicate right amplitude inverted impulse data and the duplicate left amplitude inverted impulse data based on the applying of the inverse amplitude function to the duplicate right channel measurement data and the duplicate left channel measurement data, wherein the convolving comprises:

convolving the right channel measurement data with the duplicate right phase reversed impulse data and the left channel measurement data with the duplicate left phase reversed impulse data based on the generating of the duplicate right phase reversed impulse data and the duplicate left phase reversed impulse data; and convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data, wherein the right impulse data comprises a right amplitude impulse data and a right phase impulse data, wherein the left impulse data comprises a left amplitude impulse data and a left phase impulse data, wherein the generating of the right impulse data and the left impulse data comprises:

generating the right amplitude impulse data and the left amplitude impulse data based on the convolving of the right channel measurement data with the duplicate right phase reversed impulse data and the left channel measurement data with the duplicate left phase reversed impulse data; and generating the right phase impulse data and the left phase impulse data based on the convolving of the right channel measurement data with the duplicate right amplitude inverted impulse data and the left channel measurement data with the duplicate left amplitude inverted impulse data.

7. The method of claim 6, wherein the right amplitude impulse data and the left amplitude impulse data comprises at least one information associated with an amplitude domain, wherein the right phase impulse data and the left phase impulse data comprises at least one information associated with a phase domain, wherein the analyzing of the right impulse data and the left impulse data comprises:

applying an amplitude difference function to the right amplitude impulse data and the left amplitude impulse data, wherein the right amplitude impulse data is subtracted from the left amplitude impulse data based on the applying of the amplitude difference function;

applying a phase reversion function to the right phase impulse data and the left phase impulse data, wherein the corrective signal data comprises a frequency matching impulse data and a phase matching impulse data, wherein the generating of the corrective signal data comprises:

generating the frequency matching impulse data based on the applying of the amplitude difference function; and generating of the phase matching impulse data based on the applying of the phase reversion function, wherein the storing of the corrective signal data comprises storing the frequency matching impulse data and the phase matching impulse data.

8. The method of claim 7, wherein the frequency matching impulse data comprises a right channel frequency matching impulse data for the right audio device driver and a left channel frequency matching impulse data for the left audio device driver, wherein the phase matching impulse data comprises a right channel phase matching impulse data for the right audio device driver and a left channel phase matching impulse data for the left audio device driver, wherein the method further comprises:

convolving, using the processing device, the right channel frequency matching impulse data and the right channel phase matching impulse data;

generating, using the processing device, a right mono impulse data based on the convolving of the right channel frequency matching impulse data and the right channel phase matching impulse data;

convolving, using the processing device, the left channel frequency matching impulse data and the left channel phase matching impulse data;

generating, using the processing device, a left mono impulse data based on the convolving of the left channel frequency matching impulse data and the left channel phase matching impulse data;

generating, using the processing device, a stereo impulse data for the linearizing of the audio device in frequency, amplitude, and time domains based on the left mono impulse data and the right mono impulse data, wherein the audio device is operated based on the stereo impulse data; and storing, using the storage device, the stereo impulse data.

9. The method of claim 1 further comprising:

receiving, using the communication device, a left channel audio signal data associated with the left channel and a right channel audio signal data associated with the right channel from an audio signal source device;

analyzing, using the processing device, the left channel audio signal data and the right channel audio signal data, wherein the analyzing comprises delaying a left channel audio signal associated with the left channel audio signal data and a right channel audio signal associated with the right channel audio signal data by a time delay;

generating, using the processing device, a delayed left channel audio signal data and a delayed right channel audio signal data based on the analyzing of the left channel audio signal data and the right channel audio signal data;

generating, using the processing device, a combined left channel audio signal data for the left channel by combining a delayed right channel audio signal associated with the delayed right channel audio signal data with the left channel audio signal and a combined right channel audio signal data for the right channel by combining a delayed left channel audio signal associated with the delayed left channel audio data with the right channel audio signal, wherein the corrective signal data comprises an output left channel audio signal data and an output right channel audio signal data, wherein the generating of the corrective signal data comprises generating the output left channel audio signal data for the left channel and the output right channel audio signal data by attenuating a combined left channel audio signal associated with the combined left channel audio signal data and a combined right channel audio signal associated with the combined right channel audio signal data using a 24 dB/Octave low pass linear phase finite impulse response (FIR) filter; and transmitting, using the communication device, the output left channel audio signal data to the left audio device driver and the output right channel audio signal data to the right audio device driver, wherein the left audio device driver is operated based on the output left channel audio signal data and the right audio device driver is operated based on the left audio device driver.

10. A system for facilitating enhanced perception of ambiance, soundstage, and imaging in audio devices, the system comprising:

a communication device configured for receiving a right channel measurement data of a right audio device driver associated with a right channel of an audio device and a left channel measurement data of a left audio device driver associated with a left channel of the audio device from a microphone, wherein the audio device comprises a headphone;

a processing device communicatively coupled with the communication device, wherein the processing device is configured for:

duplicating the right channel measurement data and the left channel measurement data;

generating a duplicate right channel measurement data for the right channel measurement data and a duplicate left channel measurement data for the left channel measurement data based on the duplicating;

applying an inversion function to the duplicate right channel measurement data and the duplicate left channel measurement data based on the generating of the duplicate right channel measurement data and the duplicate left channel measurement data;

generating a duplicate right inverted impulse data for the duplicate right channel measurement data and a duplicate left inverted impulse data for the duplicate left channel measurement data based on the applying;

convolving the right channel measurement data with the duplicate right inverted impulse data and the left channel measurement data with the duplicate left inverted impulse data based on the generating of the duplicate right inverted impulse data and the duplicate left inverted impulse data;

generating a right impulse data for the right audio device driver and a left impulse data for the left audio device driver based on the convolving;

analyzing the right impulse data and the left impulse data based on the generating of the right impulse data and the left impulse data; and generating a corrective signal data for at least one of the right audio device driver and the left audio device driver for linearizing the audio device in amplitude and time domains based on the analyzing, wherein at least one of the right audio device driver and the left audio device driver is operated based on the corrective signal data; and a storage device communicatively coupled with the processing device, wherein the storage device is configured for storing the corrective signal data.

11. The system of claim 10, wherein the applying comprises applying a phase reversion function to the duplicate right channel measurement data and the duplicate left channel measurement data, wherein the duplicate right inverted impulse data comprises a duplicate right phase reversed impulse data and the duplicate left inverted impulse data comprises a duplicate left phase reversed impulse data, wherein the generating of the duplicate right inverted impulse data and the duplicate left inverted impulse data comprises generating the duplicate right phase reversed impulse data and the duplicate left phase reversed impulse data based on the applying of the phase reversion function, wherein the convolving comprises convolving the right channel measurement data with the duplicate right phase reversed impulse data and the left channel measurement data with the duplicate left phase reversed impulse data based on the generating of the duplicate right phase reversed impulse data and the duplicate left phase reversed impulse data, wherein the right impulse data comprises a right amplitude impulse data and the left impulse data comprises a left amplitude impulse data, wherein the generating of the right impulse data and the left impulse data comprises generating the right amplitude impulse data and the left amplitude impulse data based on the convolving of the right channel measurement data with the duplicate right phase reversed impulse data and the left channel measurement data with the duplicate left phase reversed impulse data.

12. The system of claim 11, wherein the right amplitude impulse data and the left amplitude impulse data comprises at least one information associated with an amplitude domain, wherein the analyzing of the right impulse data and the left impulse data comprises applying an amplitude difference function to the right amplitude impulse data and the left amplitude impulse data, wherein the right amplitude impulse data is subtracted from the left amplitude impulse data based on the applying of the amplitude difference function, wherein the corrective signal data comprises a frequency matching impulse data, wherein the generating of the corrective signal data comprises generating the frequency matching impulse data based on the applying of the amplitude difference function.

13. The system of claim 10, wherein the applying comprises applying an inverse amplitude function to the duplicate right channel measurement data and the duplicate left channel measurement data, wherein the duplicate right inverted impulse data comprises a duplicate right amplitude inverted impulse data and the duplicate left inverted impulse data comprises a duplicate left amplitude inverted impulse data, wherein the generating of the duplicate right inverted impulse data and the duplicate left inverted impulse data comprises generating the duplicate right amplitude inverted impulse data and the duplicate left amplitude inverted impulse data based on the applying of the inverse amplitude function, wherein the convolving comprises convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data, wherein the right impulse data comprises a right phase impulse data and the left impulse data comprises a left phase impulse data, wherein the generating of the right impulse data and the left impulse data comprises generating the right phase impulse data and the left phase impulse data based on the convolving of the right channel measurement data with the duplicate right amplitude inverted impulse data and the left channel measurement data with the duplicate left amplitude inverted impulse data.

14. The system of claim 13, wherein the right phase impulse data and the left phase impulse data comprises at least one information associated with a phase domain, wherein the analyzing of the right impulse data and the left impulse data comprises applying a phase reversion function to the right phase impulse data and the left phase impulse data, wherein the corrective signal data comprises a phase matching impulse data, wherein the generating of the corrective signal data comprises generating of the phase matching impulse data based on the applying of the phase reversion function.

15. The system of claim 10, wherein the applying comprises:

applying a phase reversion function to the duplicate right channel measurement data and the duplicate left channel measurement data; and applying an inverse amplitude function to the duplicate right channel measurement data and the duplicate left channel measurement data, wherein the duplicate right inverted impulse data comprises a duplicate right phase reversed impulse data and a duplicate right amplitude inverted impulse data and the duplicate left inverted impulse data comprises a duplicate left phase reversed impulse data and a duplicate left amplitude inverted impulse data, wherein the generating of the duplicate right inverted impulse data and the duplicate left inverted impulse data comprises:

generating the duplicate right phase reversed impulse data and the duplicate left phase reversed impulse data based on the applying of the phase reversion function to the duplicate right channel measurement data and the duplicate left channel measurement data; and generating the duplicate right amplitude inverted impulse data and the duplicate left amplitude inverted impulse data based on the applying of the inverse amplitude function to the duplicate right channel measurement data and the duplicate left channel measurement data, wherein the convolving comprises:

convolving the right channel measurement data with the duplicate right phase reversed impulse data and the left channel measurement data with the duplicate left phase reversed impulse data based on the generating of the duplicate right phase reversed impulse data and the duplicate left phase reversed impulse data; and convolving the right channel measurement data with the duplicate right amplitude inverted impulse data and the left channel measurement data with the duplicate left amplitude inverted impulse data based on the generating of the duplicate right amplitude inverted impulse data and the duplicate left amplitude inverted impulse data, wherein the right impulse data comprises a right amplitude impulse data and a right phase impulse data, wherein the left impulse data comprises a left amplitude impulse data and a left phase impulse data, wherein the generating of the right impulse data and the left impulse data comprises:

generating the right amplitude impulse data and the left amplitude impulse data based on the convolving of the right channel measurement data with the duplicate right phase reversed impulse data and the left channel measurement data with the duplicate left phase reversed impulse data; and generating the right phase impulse data and the left phase impulse data based on the convolving of the right channel measurement data with the duplicate right amplitude inverted impulse data and the left channel measurement data with the duplicate left amplitude inverted impulse data.

16. The system of claim 15, wherein the right amplitude impulse data and the left amplitude impulse data comprises at least one information associated with an amplitude domain, wherein the right phase impulse data and the left phase impulse data comprises at least one information associated with a phase domain, wherein the analyzing of the right impulse data and the left impulse data comprises:

applying an amplitude difference function to the right amplitude impulse data and the left amplitude impulse data, wherein the right amplitude impulse data is subtracted from the left amplitude impulse data based on the applying of the amplitude difference function;

applying a phase reversion function to the right phase impulse data and the left phase impulse data, wherein the corrective signal data comprises a frequency matching impulse data and a phase matching impulse data, wherein the generating of the corrective signal data comprises:

generating the frequency matching impulse data based on the applying of the amplitude difference function; and generating of the phase matching impulse data based on the applying of the phase reversion function, wherein the storing of the corrective signal data comprises storing the frequency matching impulse data and the phase matching impulse data.

17. The system of claim 16, wherein the frequency matching impulse data comprises a right channel frequency matching impulse data for the right audio device driver and a left channel frequency matching impulse data for the left audio device driver, wherein the phase matching impulse data comprises a right channel phase matching impulse data for the right audio device driver and a left channel phase matching impulse data for the left audio device driver, wherein the processing device is further configured for:

convolving the right channel frequency matching impulse data and the right channel phase matching impulse data;

generating a right mono impulse data based on the convolving of the right channel frequency matching impulse data and the right channel phase matching impulse data;

convolving the left channel frequency matching impulse data and the left channel phase matching impulse data;

generating a left mono impulse data based on the convolving of the left channel frequency matching impulse data and the left channel phase matching impulse data; and generating a stereo impulse data for the linearizing of the audio device in frequency, amplitude, and time domains based on the left mono impulse data and the right mono impulse data, wherein the audio device is operated based on the stereo impulse data, wherein the storage device is further configured for storing the stereo impulse data.

18. The system of claim 10, wherein the communication device is further configured for:

receiving a left channel audio signal data associated with the left channel and a right channel audio signal data associated with the right channel from an audio signal source device; and transmitting an output left channel audio signal data to the left audio device driver and an output right channel audio signal data to the right audio device driver, wherein the left audio device driver is operated based on the output left channel audio signal data and the right audio device driver is operated based on the left audio device driver, wherein the processing device is further configured for:

analyzing the left channel audio signal data and the right channel audio signal data, wherein the analyzing comprises delaying a left channel audio signal associated with the left channel audio signal data and a right channel audio signal associated with the right channel audio signal data by a time delay;

generating a delayed left channel audio signal data and a delayed right channel audio signal data based on the analyzing of the left channel audio signal data and the right channel audio signal data; and generating a combined left channel audio signal data for the left channel by combining a delayed right channel audio signal associated with the delayed right channel audio signal data with the left channel audio signal and a combined right channel audio signal data for the right channel by combining a delayed left channel audio signal associated with the delayed left channel audio data with the right channel audio signal, wherein the corrective signal data comprises the output left channel audio signal data and the output right channel audio signal data, wherein the generating of the corrective signal data comprises generating the output left channel audio signal data for the left channel and the output right channel audio signal data by attenuating a combined left channel audio signal associated with the combined left channel audio signal data and a combined right channel audio signal associated with the combined right channel audio signal data using a 24 dB/Octave low pass linear phase finite impulse response (FIR) filter.

* * * * *